US010947169B2

(12) United States Patent
Brown et al.

(10) Patent No.: US 10,947,169 B2
(45) Date of Patent: Mar. 16, 2021

(54) DEPLOYABLE EXPLOSIVE CHARGE STRUCTURE

(71) Applicant: River Front Services, Inc., Chantilly, VA (US)

(72) Inventors: Anthony Miles Brown, Sneads Ferry, NC (US); Donald Ray Brown, Oakton, VA (US); Darby William McDermott-Brown, South Riding, VA (US)

( * ) Notice: Subject to any disclaimer, the term of this patent is extended or adjusted under 35 U.S.C. 154(b) by 0 days.

(21) Appl. No.: 16/457,742

(22) Filed: Jun. 28, 2019

(65) Prior Publication Data

US 2020/0002242 A1 Jan. 2, 2020

Related U.S. Application Data

(60) Provisional application No. 62/692,583, filed on Jun. 29, 2018.

(51) Int. Cl.
*C06C 5/04* (2006.01)

(52) U.S. Cl.
CPC ..... *C06C 5/04* (2013.01)

(58) Field of Classification Search
CPC ..... F42D 1/043; F42D 1/04; C06C 5/06
USPC ..... 102/275.8
See application file for complete search history.

(56) References Cited

U.S. PATENT DOCUMENTS 2,687,866 A 8/1954 Johnson
2,911,910 A 11/1959 Welsh
3,169,478 A * 2/1965 Schaaf ..... F42B 3/093 102/332
3,320,883 A * 5/1967 Welsh ..... C06C 5/04 102/275.8
3,327,979 A 6/1967 Akio
3,374,737 A * 3/1968 Pike ..... F42B 1/02 102/275.5
3,431,574 A 3/1969 Mathieu
3,782,284 A * 1/1974 Gibb ..... B64C 1/32 102/275.8
3,783,787 A 1/1974 Thornley et al.
4,015,506 A * 4/1977 Musgrave ..... F41H 11/08 89/1.11

(Continued)

FOREIGN PATENT DOCUMENTS

EP 0015067 A1 9/1980
EP 3538837 9/2019

(Continued)

OTHER PUBLICATIONS

"International Search Report and Written Opinion issued in International Patent Application No. PCT/US2018/047861, dated Jan. 24, 2020, filed Aug. 24, 2018", 20 pages.

(Continued)

*Primary Examiner* — Joshua E Freeman

(57) ABSTRACT

A deployable explosive charge structure includes a carpenter's tape capable of transitioning from an undeployed state to a deployed state in which the tape extends linearly over its length, an explosive charge connected to the carpenter's tape, a connecting structure for connecting the carpenter's tape and the explosive charge, and a two-sided adhesive tape for engaging a structure (for example, a door or wall) when the carpenter's tape is in the deployed state.

24 Claims, 25 Drawing Sheets

(56) References Cited

U.S. PATENT DOCUMENTS

| | | | | |
|---|---|---|---|---|
| 4,408,535 | A * | 10/1983 | Alford | F42B 1/00 102/305 |
| 4,499,828 | A | 2/1985 | Honodel | |
| 4,813,358 | A | 3/1989 | Roberts | |
| 4,856,430 | A | 8/1989 | Gibb et al. | |
| 5,020,435 | A * | 6/1991 | Cawte | C06C 5/04 102/275.1 |
| 6,006,671 | A | 12/1999 | Yunan | |
| 7,802,509 | B2 | 9/2010 | Wall | |
| 7,819,063 | B1 * | 10/2010 | Lehman | F42D 3/00 102/301 |
| 7,926,423 | B2 | 4/2011 | Rickman et al. | |
| 7,934,292 | B2 | 5/2011 | Degner et al. | |
| 8,006,621 | B1 | 8/2011 | Cherry | |
| 8,194,403 | B2 | 6/2012 | Liu | |
| 8,267,013 | B2 | 9/2012 | Moore | |
| 8,826,821 | B2 | 9/2014 | Martin | |
| 8,904,937 | B2 * | 12/2014 | Mangolds | F42B 3/087 102/320 |
| 9,709,213 | B2 | 7/2017 | Zheng | |
| 9,857,831 | B2 | 1/2018 | Senatori et al. | |
| 9,909,035 | B1 * | 3/2018 | Caldeira | B32B 7/06 |
| 2001/0055540 | A1 * | 12/2001 | Bonamarte | A61L 9/122 422/4 |
| 2005/0092877 | A1 | 5/2005 | Carnevali | |
| 2005/0126420 | A1 | 6/2005 | Givens et al. | |
| 2005/0179724 | A1 | 8/2005 | Salt et al. | |
| 2011/0072956 | A1 | 3/2011 | Wall | |
| 2011/0197779 | A1 | 8/2011 | Moore | |
| 2012/0073155 | A1 | 3/2012 | Mabey | |
| 2012/0074291 | A1 | 3/2012 | Fu | |
| 2012/0106043 | A1 | 5/2012 | Murakata et al. | |
| 2012/0145027 | A1 | 6/2012 | Martin | |
| 2014/0048672 | A1 | 2/2014 | Woodruff et al. | |
| 2015/0008302 | A1 | 1/2015 | Fan | |
| 2015/0092427 | A1 | 4/2015 | Nopper | |
| 2015/0108313 | A1 | 4/2015 | Leung | |
| 2015/0184799 | A1 | 7/2015 | Whitney | |
| 2015/0292672 | A1 | 10/2015 | Dose | |
| 2016/0134733 | A1 | 5/2016 | Murphy et al. | |
| 2016/0226126 | A1 | 8/2016 | Daton-Lovett | |
| 2016/0286016 | A1 | 9/2016 | Lee et al. | |
| 2017/0223862 | A1 | 8/2017 | Justiss et al. | |
| 2018/0128419 | A1 * | 5/2018 | Brown | F16M 11/40 |
| 2019/0063892 | A1 | 2/2019 | Brown et al. | |
| 2019/0103650 | A1 | 4/2019 | Daton-Lovett | |
| 2020/0132247 | A1 | 4/2020 | Brown | |
| 2020/0284570 | A1 | 9/2020 | Brown | |

FOREIGN PATENT DOCUMENTS

| | | | |
|---|---|---|---|
| EP | 3673227 | A2 | 7/2020 |
| FR | 2300325 | A1 | 9/1976 |
| GB | 1415204 | A | 11/1975 |
| WO | 9600879 | A1 | 1/1996 |
| WO | 2008045118 | A2 | 4/2008 |
| WO | 2018089530 | A1 | 5/2018 |
| WO | 2019199346 | A2 | 10/2019 |
| WO | 2020055500 | A2 | 3/2020 |

OTHER PUBLICATIONS

Madeira, "Invitation to Pay Additional Fees issued in International Patent Application No. PCT/US2018/047861 filed Aug. 14, 2018", dated Nov. 21, 2019, 15 pages.

"Gryphon Engineering Services, Gryphon Engineering | Folding Entry Prop Pole (4 Piece), web page as of Oct. 3, 2016."

"Extended European Search Report for European Patent Application No. 17869384.2", dated Jul. 13, 2020, 8 pages.

"Ensign-Bickford Aerospace & Defense, Rapid Wall Breaching Kit, web page as of Oct. 3, 2016."

"International Search Report and Written Opinion PCT/US2017/060685", dated Jan. 22, 2018, 9 pages.

"Notification of Transmittal of international Preliminary Report on Patentability (Chapter II of the Patent Cooperation Treaty) and International Preliminary Report on Patentability (Chapter II of the Patent Cooperation Treaty) for PCT/US2017/060685", dated Oct. 19, 2018, 9 pages.

"Notification of Transmittal of International Preliminary Report on Patentability (Chapter II), and Communication in Cases for Which No Other Form is Applicable for PCT/US2017/060685", dated Dec. 3, 2018, 14 pages.

"International Search Report and Written Opinion issued in International Patent Application No. PCT/US2019/039991 filed Jun. 28, 2019", dated Jun. 8, 2020, 16 pages.

Lou, et al., "A Combined Analytical and Experimental Study on Space Inflatable Booms", Aerospace Conference Proceedings, 2000, IEEE, Mar. 18-25, 2000 vol. 2, Mar. 18, 2000, 503-511.

U.S. Appl. No. 16/111,481 to Brown et al. filed Aug. 24, 2018.

U.S. Appl. No. 15/807,274 to Brown et al. filed Nov. 8, 2017.

"International Search Report & Written Opinion issued in PCT International Application No. PCT/US2020/033660 filed May 19, 2020", dated Sep. 15, 2020, 13 pages.

U.S. Appl. No. 16/878,450 to Brown et al. filed May 19, 2020.

* cited by examiner

DEPLOYABLE EXPLOSIVE CHARGE STRUCTURE

RELATED APPLICATIONS

This application claims priority to U.S. Provisional Patent Application No. 62/692,583 filed Jun. 29, 2018 and titled "Deployable, Linear Explosive Charge Structure." The complete disclosure of the above-identified priority application is hereby fully incorporate herein by reference.

TECHNICAL FIELD

The technology disclosed herein relates to a deployable, linear explosive charge structure comprising an explosive charge and a deployable structure that supports the explosive charge and is adapted to transition from a undeployed state characterized by the ends of the deployable structure being relatively close to one another to a deployed state in which the ends of the deployable structure are farther apart from one another than in the undeployed state and such that a substantial portion of the charge located between the ends of the deployable structure extends linearly.

BACKGROUND

Presently, conventional linear explosive charge structures suitable for breaching applications are made by sandwiching a strip of sheet explosives (for example, Detasheet® explosive) or detonation cord between two layers of duct tape or similar tape. To elaborate, the strip of sheet explosive or detonation cord is trapped between the adhesive sides of the two layers of duct tape to form a composite tape-explosive structure. The non-adhesive sides of the two layers of duct tape form the outside surface of the composite structure. Because the non-adhesive sides of the two layers of tape are on the outside of the composite structure, the two layers of duct tape allow the sandwiched explosive to be rolled or folded such that adjacent layers of the explosive in the roll or folded structure are separated from one another and cannot stick to, or become tangled with, one another. These conventional structures are very flexible and do not hold a shape. Such structures are similar in physical properties to rolling up a piece of hose.

Further, a two-sided adhesive tape is attached to the non-adhesive side of the duct tape structure to complete the linear explosive charge structure. As such, the two-sided adhesive tape has an "interior" adhesive side that is attached to the duct tape structure and an exterior "adhesive" side that facilitates attachment of the linear explosive charge structure to another structure (for example, a door that is to be breached). The structure is then rolled or folded for transport. In use, the explosive charge structure has to be unrolled or unfolded, which is typically time consuming. Further, if a removable backing does not cover the exterior adhesive side of the two-sided adhesive tape, the exterior adhesive side of the tape typically comes into contact with another portion of the rolled or folded, linear explosive charge structure, thereby requiring that the layers of the rolled or folded structure be "ripped" apart, like removing a piece of masking tape from a roll of masking tape, and thereby requiring even more time to deploy the structure.

It is a time consuming task to unroll a conventional explosive structure in the field. These conventional explosive structures are flexible in both the rolled and unrolled positions. Additionally, it is a difficult task to unroll a conventional, flexible explosive structure, to maintain positioning of the flexible structure, and to deploy the flexible structure. Such deployment is especially difficult under dangerous circumstances, such as combat situations, and when taking cover with little room to move.

Other conventional linear explosive charge structures attach an explosive to a stiff backing material (for example, cardboard or wood) to form a composite structure that can be rolled or folded. A piece of two-sided adhesive tape is added to the composite structure to enable the structure to be attached to an object of interest. These conventional structures are also time consuming to deploy. In combat situations, the soldier deploying such linear explosive charge structure is stationary and typically unable to perceive threats or readily take defensive action even if a threat is perceived. Additionally, these conventional stiff explosive structures may damage the explosive charge when rolling or folding the structures. When rolling a stiff backing material, the explosive attached to the backing material can be subjected to shear flow and tearing dynamics that can damage the explosive charge. Various compression and/or extension forces act on the explosive charge, which can damage the explosive charge. A stiff structure that is folded typically includes hinges or hinge locations to fold the structure. As the explosive charge is folded under or over the hinge locations, the explosive charge is subjected to the compression and/or extension forces that can damage the explosive charge.

SUMMARY

The invention is directed to a deployable, linear explosive charge structure that includes: (a) an explosive charge made of a flexible material (for example, Detasheet explosive or detonation cord), (b) a carpenter's tape that carries or supports the explosive charge and is capable of self-deploying from an undeployed state to a deployed state, (c) a connector for connecting the explosive charge and the deployable structure, and (d) an adhesive structure for connecting the deployed tape structure and explosive charge to another structure.

Characteristic of carpenter's tape is that, in the deployed state, the tape extends linearly between the ends of the tape and has a transverse curve over the deployed length of the tape that gives the deployed tape beam-like characteristics which allow the tape to be supported at one end and extend a considerable distance to a free or unsupported end. Also characteristic of carpenter's tape is that the tape can be rolled from one end to the other end (producing an Archimedean spiral roll) with the rolling resulting in the transverse curve in the tape being removed as the rolling operation progresses. A carpenter's tape can also be folded so as form a "flattened" roll or to follow a serpentine path. In either case, there are linear sections of tape, which each have the noted transverse curve, that are separated from one another by a curved section that lacks the transverse curve. In the undeployed state, the carpenter's tape stores potential energy that, if applied, causes the tape to transition from the undeployed state to or towards the deployed state, i.e., the tape is capable of self-deployment. If the carpenter's tape is a metal carpenter's tape (such as is found in a carpenter's measuring tape), the deployable, linear explosive structure requires a restraint to hold the carpenter's tape in the undeployed state regardless of whether the tape in the undeployed state is disposed in an Archimedean spiral, a "flattened" roll, or follows a serpentine path. In contrast, the carpenter's tape can be a bistable, carpenter's tape made from a carbon fiber composite, fiberglass, or other suitable material. The two states in which the tape is stable are: (a) when substantially the entire tape is disposed in an Archimedean roll (i.e., the undeployed state) and (b) when substantially the entire tape extends linearly (i.e., the deployed state). If the tape is between these two stable states, (i.e., a portion of the tape is rolled up and a portion of the tape extends linearly or is partially deployed), the energy store in the tape is automatically applied to transition the tape towards one of the two stable states. Since one of the two stable states is the undeployed state in which the tape is disposed in an Archimedean spiral, this use of a bistable carpenter's tape avoids the need for any kind of restraining device. A bistable carpenter's tape can also be used when the undeployed state is a "flattened" roll or follows a serpentine path. However, a restraining device will likely be needed to maintain the tape in the undeployed state. A carpenter's tape that is not bistable and is made from carbon fiber composite, fiberglass, or other suitable material can also be employed. The use of such a carpenter's tape will require, like the metal carpenter's tape, a restraining mechanism to hold the tape in the undeployed state.

The connector for connecting the explosive to the carpenter's tape can take a number of forms. Among the factors that can affect the type of connector employed are: (a) the length of the explosive charge when the carpenter's tape in the deployed state, (b) whether the carpenter's tape is in an Archimedean spiral, "flattened" roll, or follows a serpentine path in the undeployed state, (c) whether a metal carpenter's tape or a bistable carpenter's tape is employed, and (d) the shape of the explosive charge (for example detonating cord with a circular cross-section or Detasheet explosive with a planar cross-section). Among the possible connectors are adhesive tape, low-stiffness adhesive tape, adhesive tape with a non-adhesive section bounded by adhesive edges that engage the carpenter's tape (the non-adhesive section being disposed adjacent to the allowing the explosive charge and allowing the charge to move), C-shaped wire clips with the ends of each of the clips capturing the edges of the tape and the intermediate section capturing the explosive charge, short tubes through which the explosive charge passes and that allow the explosive charge to move.

The adhesive structure for connecting the deployed carpenter's tape and explosive charge to be attached to another structure (for example, a door that is to be breached) can also take a number of forms. In one embodiment, a two-sided adhesive tape with a sacrificial backing material attached to at least one side of the tape is employed. To elaborate, one of the adhesive sides of the tape is attached to the carpenter's tape, this side of the two-sided adhesive tape is referred to as the "interior" side of the tape. The other side of the two-sided adhesive tape is referred to as the "exterior" side of the tape and has a readily removable, sacrificial backing material that covers the adhesive substance associated with the exterior side of the tape. When the deployable, linear explosive charge structure is in the undeployed state (Archimedean spiral, "flattened" roll, or following a serpentine path), the backing material prevents the "exterior" side of the tape from adhering to other portions of the structure. As such, the "exterior" side of the tape does not substantially inhibit the transition of the deployable, linear explosive charge structure between the undeployed and deployed states (i.e., the "ripping of a length of masking tape from a roll of masking tape" effect is substantially avoided). As such, the energy stored in the carpenter's tape in the undeployed state is sufficient for self-deployment of the carpenter's tape and the linear explosive charge from the undeployed state to the deployed state once any restraint that might be needed to hold the structure in the undeployed state is removed.

The elements of the deployable, linear explosive charge structure can have a number of different orientations. For instance, the explosive charge can be located on either side of the carpenter's tape. To elaborate, when the carpenter's tape is in the deployed state, the explosive charge can be located adjacent to either the concave side or the convex side of the tape. The explosive charge can also be positioned adjacent to either edge of the carpenter's tape. The two-sided adhesive tape can also be located, when considered with respect to a deployed carpenter's tape, can be deployed adjacent to the convex side (i.e., closer to the convex side than to the concave side) or adjacent to the concave side (i.e., closer to the concave side that the convex side). Further, one side of a two-side adhesive tape can also be used to connect the explosive charge and the carpenter's tape and the other side of the tape can be used to connect the carpenter's tape and linear explosive charge to another structure.

The deployable, explosive linear charge structure can be provided to a user as a kit. To elaborate, a kit with carpenter's tape, suitable explosive charge for being carried or supported by the carpenter's tape, and material(s) for connecting the carpenter's tape to a suitable explosive material and for connecting the composite structure of the carpenter's tape and explosive charge to another structure can be provided to a user. The user can then assemble the materials so as to form a deployable, linear explosive charge structure. Typically, this will be done such that the resulting structure is in the deployed state. Once assembled, the structure will then be placed in the undeployed state and, if necessary, held in the undeployed state by a restraining mechanism, which is also part of the structure. In some embodiments, the kit may not include a suitable explosive charge because the assembler will be using whatever suitable explosive material is available to them.

In use, the deployable, explosive linear charge structure is initially in an undeployed state (i.e., in an Archimedean spiral, a "flattened" roll, or following a serpentine path). When needed, the structure is transitioned from an undeployed state to a deployed state. In an embodiment that employs a metal carpenter's tape, deployment involves removing the restraining mechanism that is holding the structure in the undeployed state. In contrast, when a bistable carpenter's tape is employed and the carpenter's tape is in an Archimedean spiral in the undeployed state, the user displaces the outer end of the carpenter's tape away from the remainder of the carpenter's, thereby placing a small portion of the carpenter's tape in the deployed state. Once a sufficient amount of the carpenter's tape has been placed in the deployed state, the carpenter's tape will self-deploy towards the deployed state. In any event, once the carpenter's tape is fully deployed, the sacrificial backing material is removed from the two-sided adhesive tape and the structure is attached to the structure of interest (for example, a door or wall that is to be breached).

DETAILED DESCRIPTION

Generally, a deployable, linear explosive charge structure is provided that includes a carpenter's tape, an explosive charge, a connector for connecting the explosive charge to the carpenter's tape, and an adhesive device for connecting the carpenter's tape and attached explosive charge to a structure (for example, a door or wall that is to be breached).

Figure 1A:
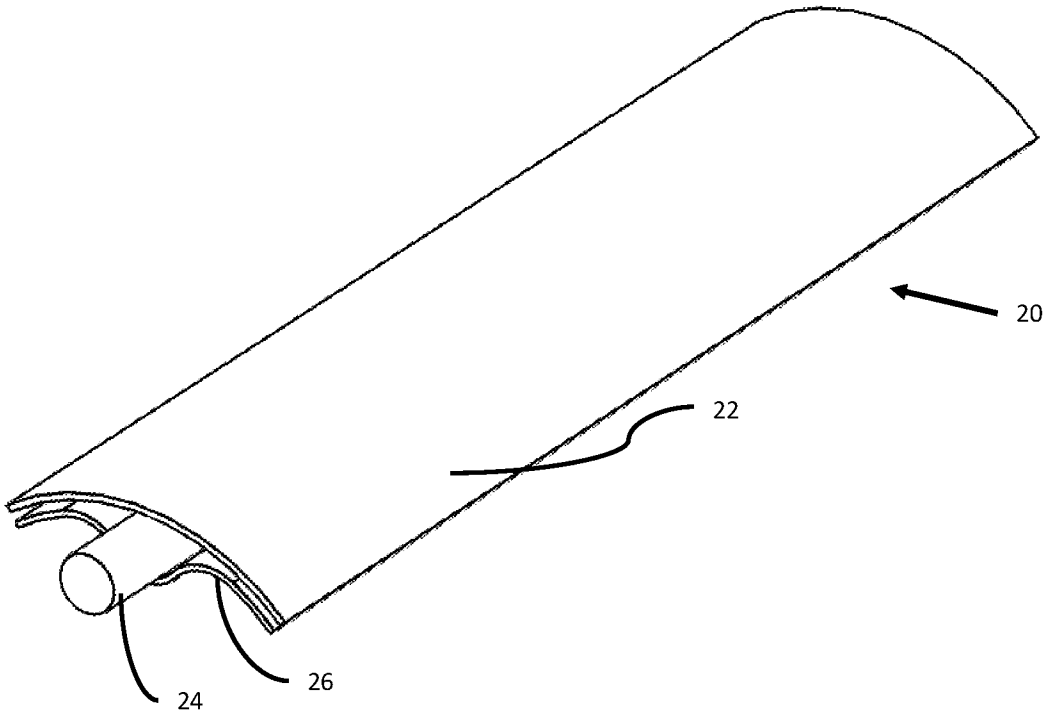
FIGS. 1A and 1B are perspective views of an embodiment of a deployable, linear explosive charge structure in a deployed state.
Figure 1B:
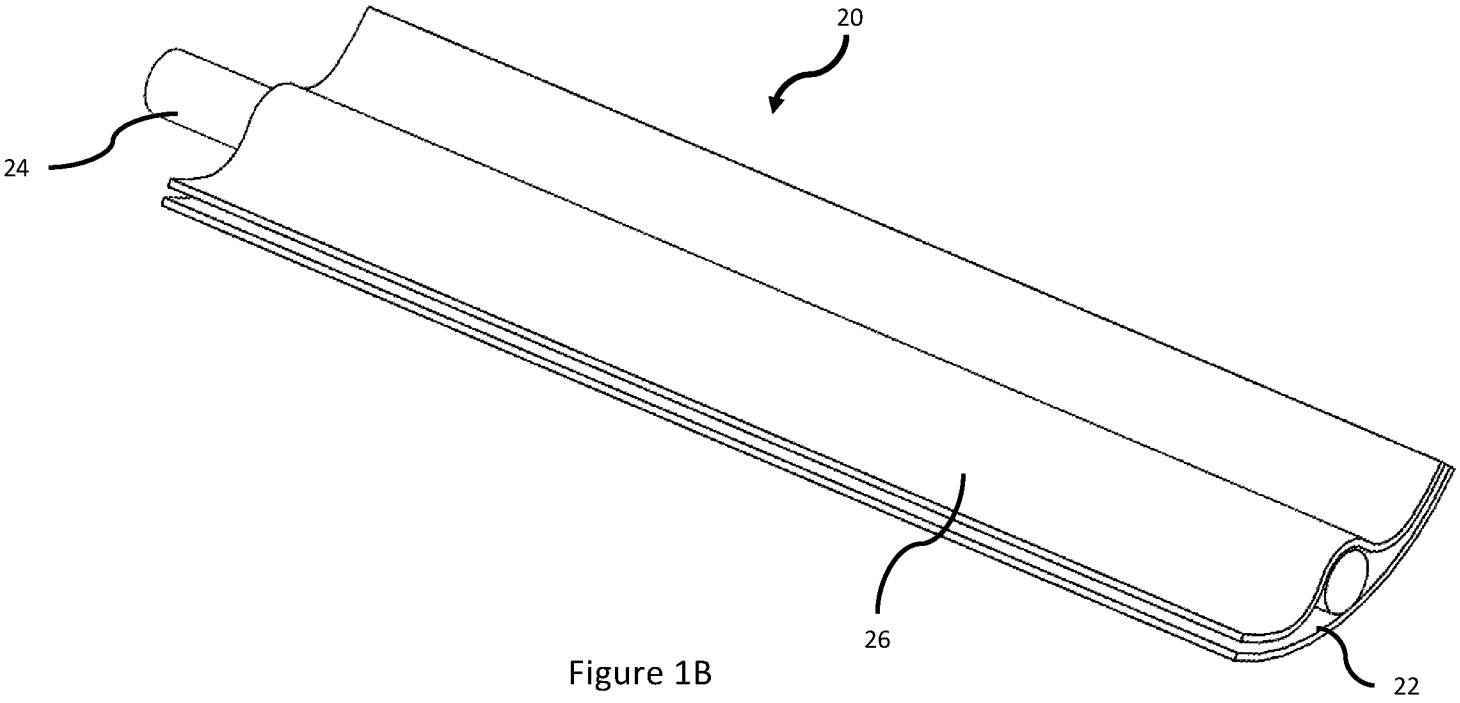
Figure 2A:
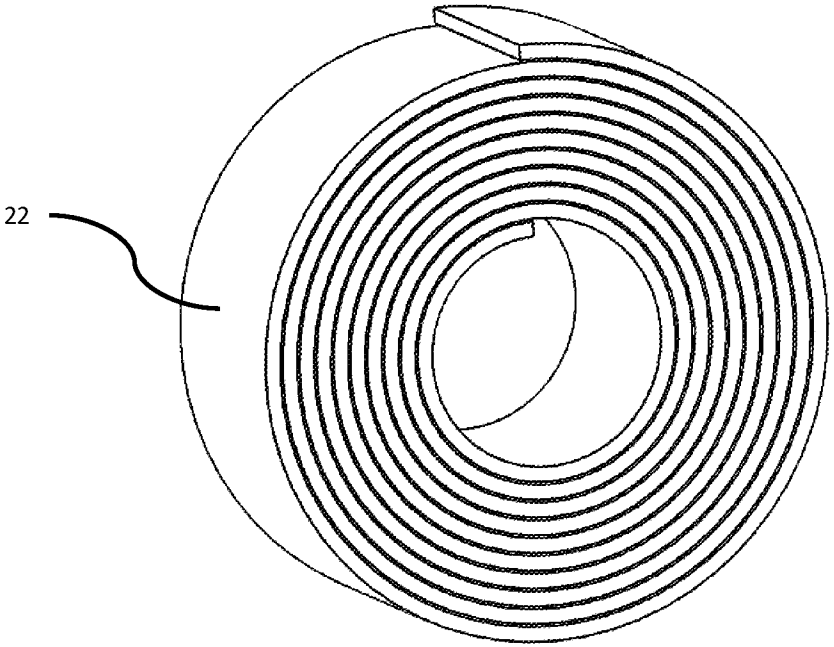
FIGS. 2A-2C are schematic diagrams of three configurations that the carpenter's tape associated with the embodiment of the deployable, linear explosive charge structure shown in FIGS. 1A and 1B can take in an undeployed state.
Figure 2B:
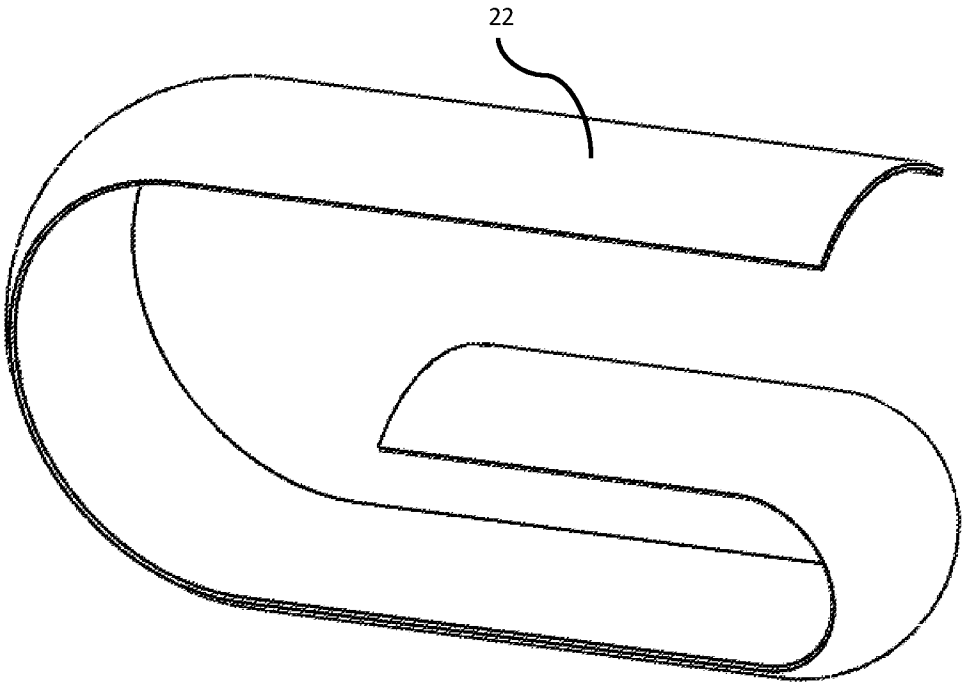
Figure 2C:
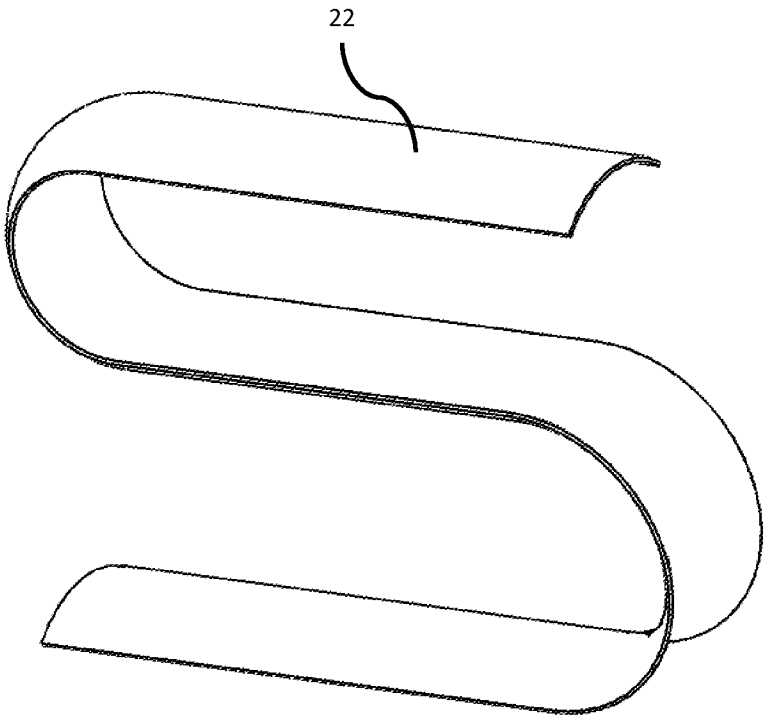
Figure 10:
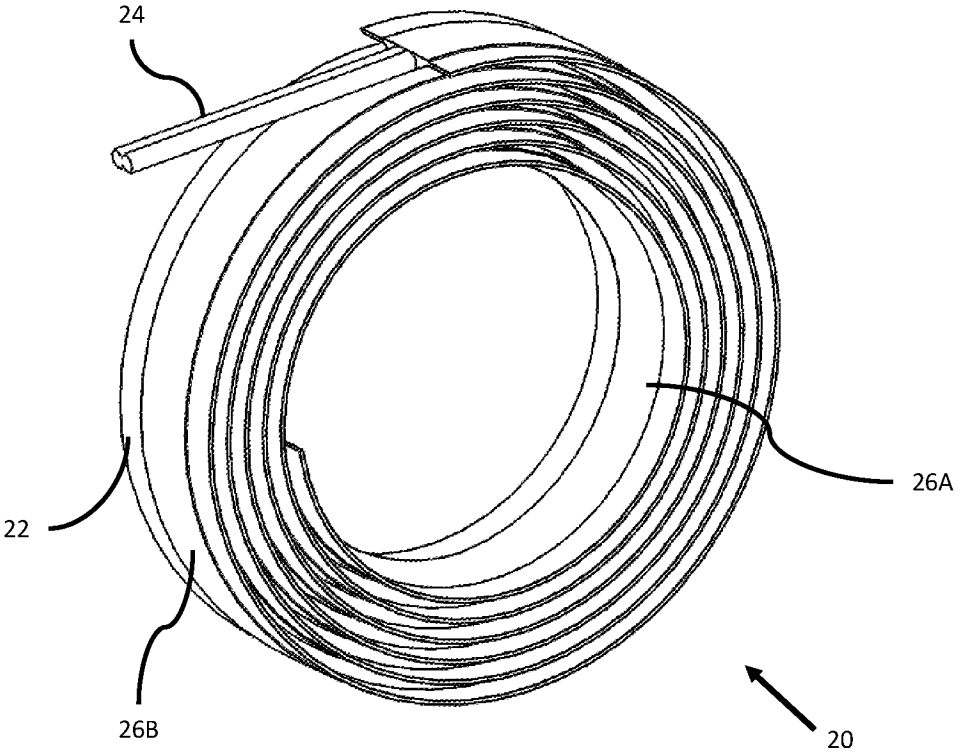
FIG. 10 illustrates the deployable, linear explosive charge structure shown in FIGS. 1A and 1B, with the structure employing a bistable carpenter's tape and being in the undeployed state.
Figure 11:
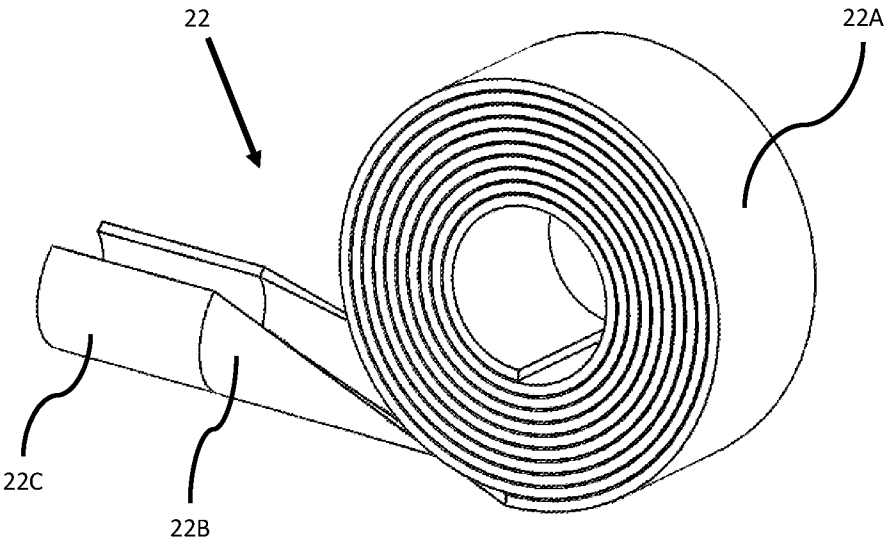
FIG. 11 depicts a carpenter's tape in the undeployed state and beginning a transition to a deployed state.
Figure 12:
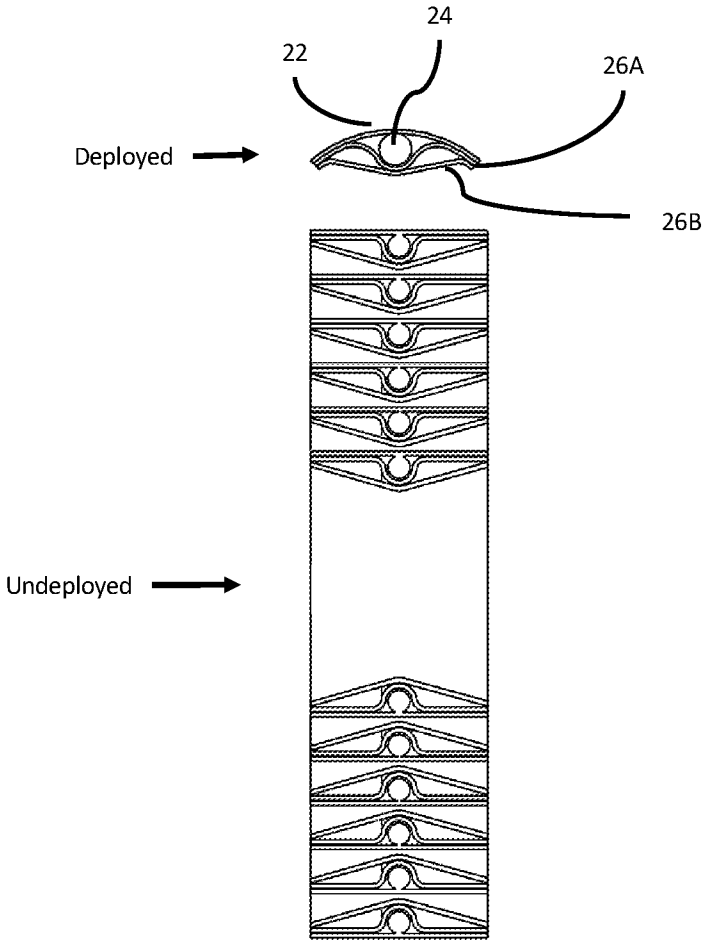
FIG. 12 depicts a cross-sectional view of an explosive structure in the undeployed state and the same explosive structure in the deployed state.

With reference to FIGS. 1A-1B and 2A-2C, an embodiment of a deployable, linear explosive charge structure 20 (hereinafter "structure 20") is described. Structure 20 includes a carpenter's tape 22, detonating cord 24, and two-sided adhesive tape 26 that serves both to connect the detonating cord 24 to the carpenter's tape 22 and to provide an adhesive surface for attaching the structure 20 to another structure (for example, door or wall). The carpenter's tape 22 is capable of being placed in a number of undeployed configurations. FIGS. 2A-2C illustrate three possible undeployed configurations that the carpenter's tape can undertake. Respectively, the three configurations are: (a) an Archimedean spiral (FIG. 2A), (b) a "flattened" roll (FIG. 2B), and (c) a serpentine path (FIG. 2C). In each of these three undeployed configurations, the carpenter's tape 22 stores energy that can subsequently be used to transition the tape from the undeployed state to the deployed state shown in FIGS. 1A and 1B. The carpenter's tape can be either a metal carpenter's tape (such as the tape used in a conventional carpenter's measuring tape), a bistable carpenter's tape, or a carpenter's tape that is made from the same material or type of materials as a bistable carpenter's tape but is not bistable. If a metal carpenter's tape is employed a restraining mechanism (for example strap) is needed to keep the structure 20 in any one of the three undeployed configurations until the structure 20 is to be deployed. If a bistable carpenter's tape is employed, a restraining device is needed if the undeployed configuration of the bistable carpenter's tape is either the "flattened" roll or the serpentine path. If, however, the undeployed configuration of the bistable carpenter's tape is the Archimedean spiral, no restraining device is needed. To elaborate, one of the stable states of the bistable carpenter's tape is the Archimedean spiral or roll. As such, the bistable carpenter's tape will remain in the Archimedean spiral or roll until action is taken to deploy the carpenter's tape and associated explosive. Specifically, once a portion of the bistable carpenter's tape is deployed by moving the outer end of the tape away from the roll so that the portion of the tape extends linearly and adopts a transverse curve, the remainder of the carpenter's tape will self-deploy so adopt the fully deployed configuration shown in FIGS. 1A and 1B. FIG. 10 illustrates the structure 20 with the structure employing a bistable carpenter's tape 22 and being in the undeployed state. As shown, the tape 22 has a flat transverse profile in the rolled, undeployed state. FIG. 11 depicts a carpenter's tape 22 in the undeployed state and beginning a transition to a deployed state. As shown in FIG. 11, the tape 22 comprises a flat, rolled profile 22*a* in the undeployed state, and a curved, linear profile 22*c* in a the deployed state, separated by a transition zone 22*b* where the tape 22 transitions from the rolled, undeployed state 22*a* to the linear, deployed state 22*c*. When fully undeployed, substantially all of the tape 22 comprises the rolled, flat profile 22*a*. When fully deployed, substantially all of the tape 22 comprises the curved, linear profile 22*c*. FIG. 12 depicts a cross-sectional view of an explosive structure in the undeployed state and the same explosive structure in the deployed state. As shown in FIG. 12, the tape 22 (and therefore the entire explosive structure) comprises the flat, rolled profile in the undeployed state and the curved profile in the deployed, linear state.

The detonating cord 24 is a flexible explosive structure that is capable of bending or deforming so as to adopt or conform to the shape of the carpenter's tape 22 in the undeployed state, the deployed state, and the transition between the undeployed and deployed states. In the deployed state, the detonating cord 24 generally adopts the linear characteristic of the deployed carpenter's tape 22. The detonating cord 24 is slightly longer than the length of the carpenter's tape 22 when the tape is deployed. As such, a portion of the detonating cord 24 extends beyond the end of the deployed carpenter's tape to for a "pigtail" that serves as a convenient place for attaching a detonating device to the structure 20. It should be appreciated that interfaces other than a "pigtail" and known to those skilled in the art can be adopted to facilitate the attachment of a detonating device to the structure 20. Embodiments that include two or more strands of detonating cord attached to the carpenter's tape 22 are feasible. In one such embodiment, a single strand of detonating cord that is slightly longer than twice the length of the carpenter's tape when deployed is folded in half and attached to the cord such that folded portion of the cord extends beyond the end of the deployed carpenter's tape and serves as a "pigtail." Other types of flexible explosives can be used in lieu of detonating cord. For instance, one such flexible explosive that can be used is Detasheet explosive, a flexible rubberized explosive. In certain embodiments, Detasheet explosive has a planar characteristic that in some architectures of the possible architecture of the deployable, linear explosive structure facilitate a relatively flat surface to which the two-sided adhesive tape can be attached, thereby yielding a relatively flat adhesive surface for engaging the structure to a surface, such as a door or wall that is to be breached.

The two-sided adhesive tape 26 has one adhesive side that engages the carpenter's tape 22 and together with the tape 26 forms a casing that encloses the detonating cord. The side of the two-sided adhesive tape 26 that cooperates with the carpenter's tape 22 to form the casing that encloses detonating cord 24 is referred to as the "interior" side of the two-sided adhesive tape 26. The opposite side of the two-sided adhesive tape 26 is referred to as the "exterior" side of the two-sided adhesive tape 26 and is the side of the two-sided adhesive tape 26 that is used to attached the structure 20 to another object (for example, door or wall that is to be breached). Associated with the exterior side of the two-sided adhesive tape 26 is a disposable backing material that covers the adhesive material associated with the exterior side of the two-sided adhesive tape 26 until the structure 20 deployed for attachment to an object. The backing material also prevents the exterior side of the two-sided adhesive tape from adhering to other parts of the structure 20 when the structure is in the undeployed state. As such, when the structure 20 is in the undeployed state and a user want to transition the structure to the deployed state, the user does not need to "rip" one layer of the structure away from another layer of the structure. Rather, the user can substantially rely on the energy stored in the undeployed carpenter's tape to transition the structure between the undeployed and deployed states. In the case of the carpenter's tape 22 being a metal carpenter's tape, the removal of whatever restraining structure is being employed to hold the structure 20 in the undeployed state will allow the structure to transition from the undeployed state to the deployed state or substantially transition from the undeployed state to the deployed states. In the case of the carpenter's tape 22 being a bistable carpenter's tape and the undeployed state for the structure 20 being either the flattened roll or the serpentine fold, removal of whatever restraining device is being employed to hold the structure in the undeployed state will allow the structure to transition from the undeployed to the deployed state or substantially transition from the undeployed state to the deployed state. In the case of the carpenter's tape 22 being a bistable carpenter's tape and the undeployed state for the structure 20 being the Archimedean spiral or roll, displacing a small portion of the carpenter's tape away from the remainder of the spiral will cause the remainder of the carpenter's tape to self-deploy to the deployed state. Once the structure 20 is deployed, the user can remove the backing portion of the two-sided adhesive tape 26 to expose the adhesive associated with the exterior side of the tape and press the exterior side into contact with the object of interest.

While the structure 20 employs the two-sided adhesive tape 26 to both connect the detonating cord 24 to the tape and to provide the adhesive surface that is used to subsequently attached the structure 20 to an object, other embodiments of the deployable, linear explosive charge structure may employ a single-sided adhesive tape to attach the explosive charge to the carpenter's tape and a two-sided adhesive tape for engaging the remainder of the structure 20 and provided an exterior side (with backing) that can subsequently be used to attach the structure to an object of interest.

With reference to FIGS. 3A, 3B, 3C, 4A, 4B, 4C, 5A, and 5B, the schematic cross-sections of several different architectures for a deployable, linear explosive charge structure are shown. The architectures that employ two-sided adhesive tape to both form part of the enclosure for the explosive charge and to provide an adhesive surface (initially covered by a backing material) for subsequent use in attaching the structure to an object of interest will employ the same reference numbers as applied to structure 20. In architectures that employ a single-sided adhesive tape to cooperate with the carpenter's tape to form the enclosure for the explosive charge and the two-sided-adhesive tape for providing an adhesive surface (initially covered by a backing material) for attaching the structure to an object of interest, the single-sided adhesive tape is identified as tape 26A and the two-sided adhesive tape is identified as tape 26B. Otherwise, the other elements in these embodiments will employ the same reference number as applied to structure 20. It should be appreciated that, while each of these architectures identifies the explosive charge as being detonating cord 24, other embodiments may employ multiple strands of detonating cord or employ a different type of flexible explosive (for example, Detasheet explosive). With respect to the two-sided adhesive tapes 26 and 26B, the exterior side of the tape is drawn with a heavier line that is intended to represent the removable backing material associated with the exterior side of the tape.

Figure 3A:
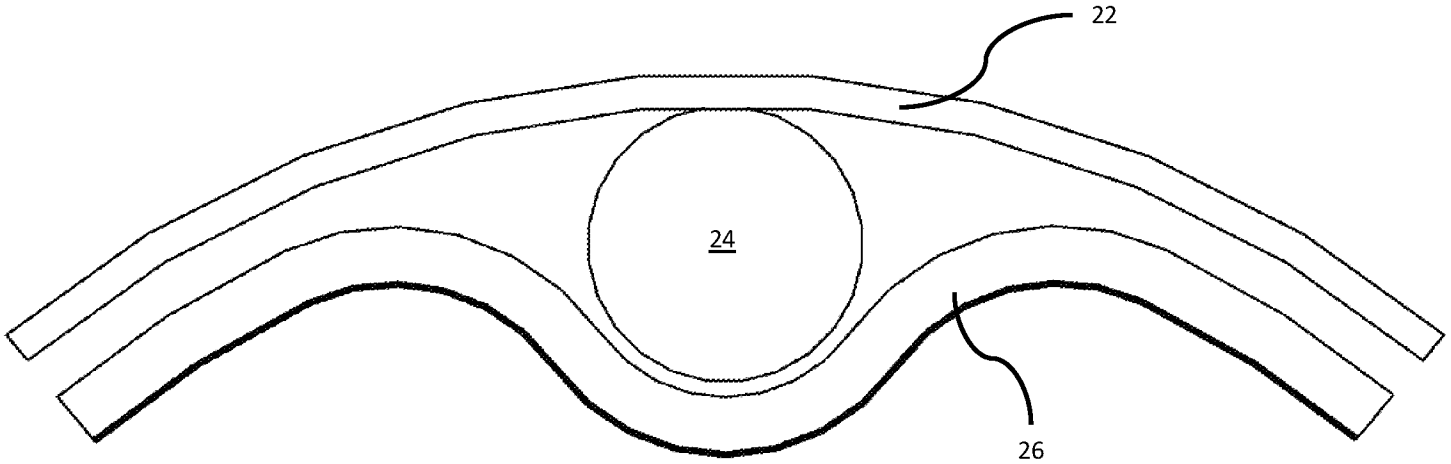
FIGS. 3A, 3B, and 3C are schematic, cross-sectional views of three architectures of a deployable, linear explosive charge structure that each have an explosive charge located on the concave side of the carpenter's tape when considered from the perspective of a deployed structure.
Figure 3B:
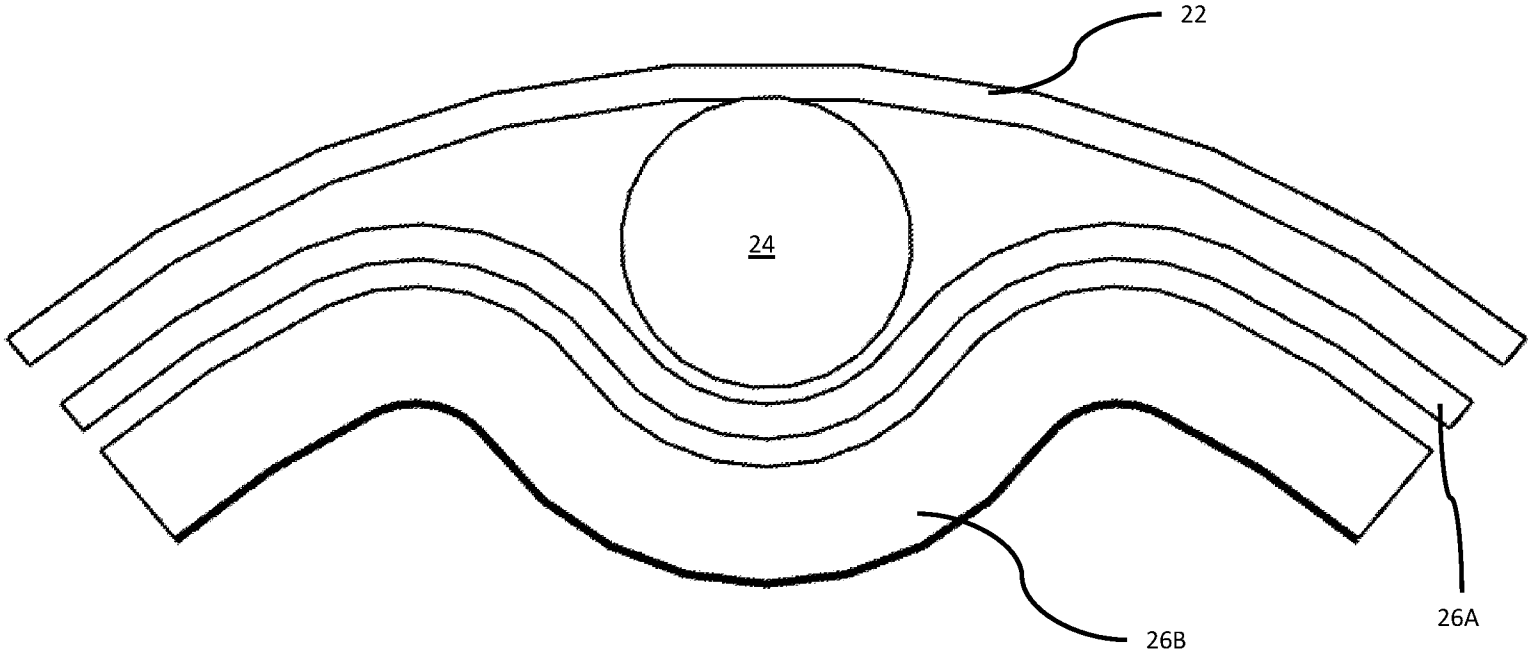
Figure 3C:
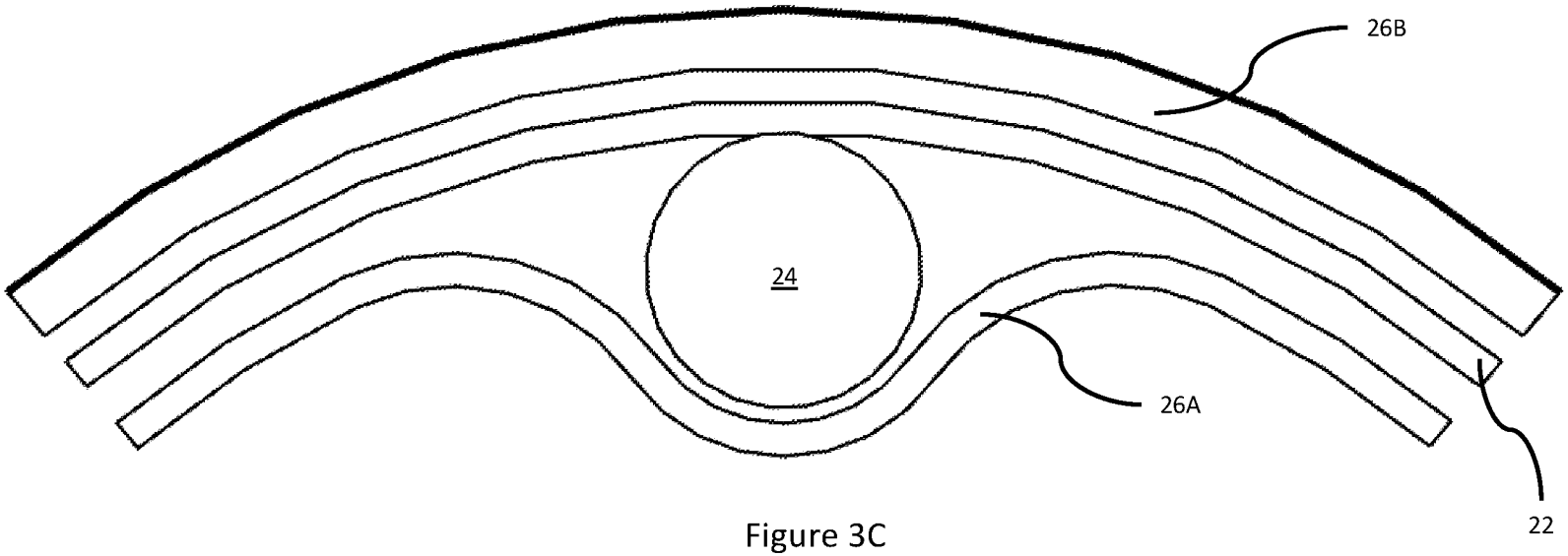

Characteristic of each of the architectures for a deployable, linear explosive charge structure shown in FIGS. 3A-3C is that the detonating cord 24 is located on the concave side of the carpenter's tape 22, the concave side being established when the structure is in the deployed state. FIG. 3A is a schematic cross-section of the architecture used in the embodiment of the structure 20 discussed with respect to FIGS. 1A-1B. In the schematic cross-section of the architecture shown in FIG. 3B, a single-sided tape 26A connects the detonating cord 24 and the carpenter's tape 22 and the interior side of the double-sided tape 26B adheres to the single-sided tape 26A. In the schematic cross-section of the architecture shown in FIG. 3C, a single-sided tape 26A connects the detonating cord 24 to the carpenter's tape 22 and the interior side of a two-sided adhesive tape 26B adheres to the convex side of the carpenter's tape.

Figure 4A:
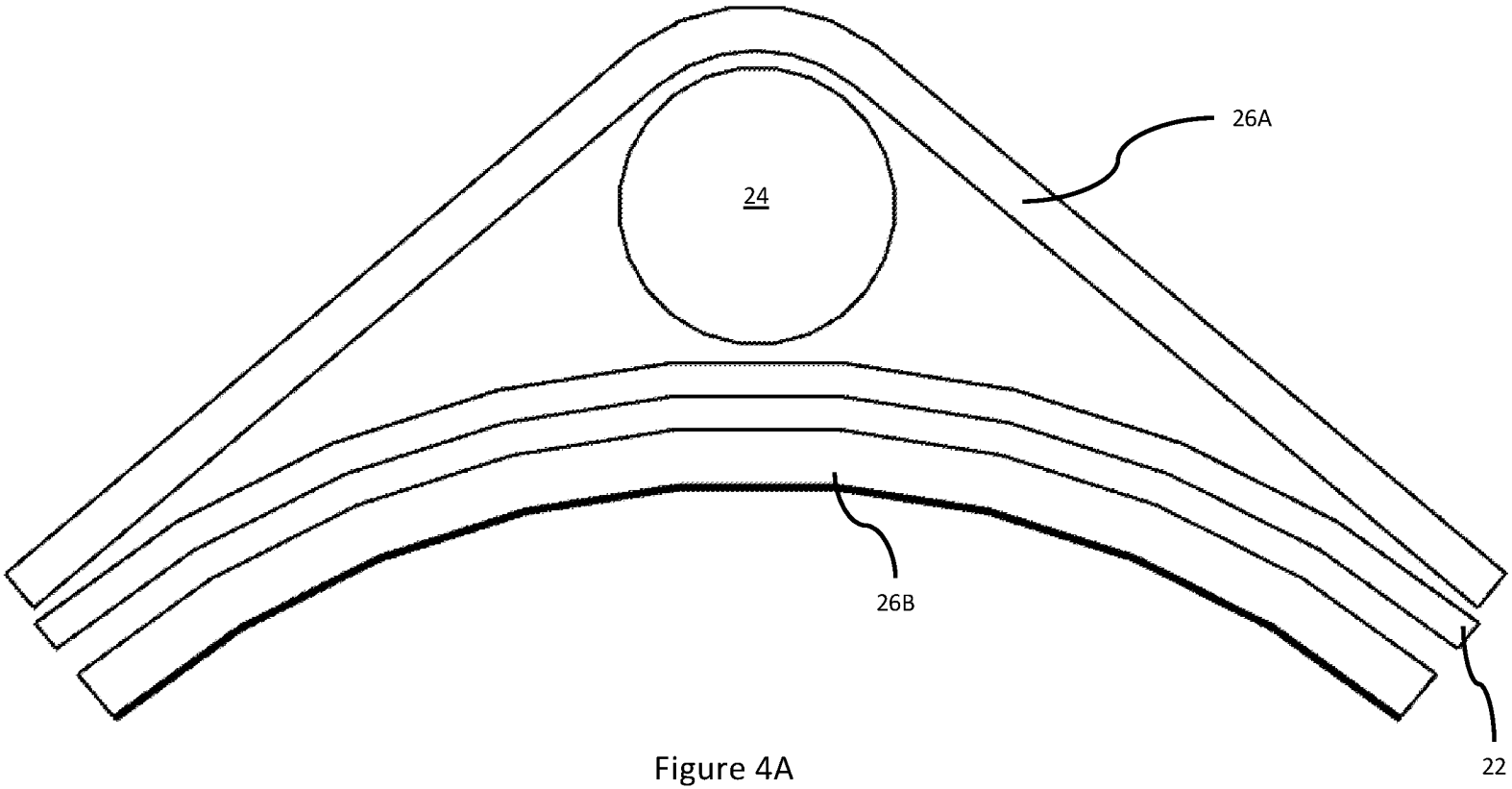
FIGS. 4A, 4B, and 4C are schematic, cross-sectional views of three architectures of a deployable, linear explosive charge structure that each have an explosive located on the convex side of the carpenter's tape when considered from the perspective of a deployed structure.
Figure 4B:
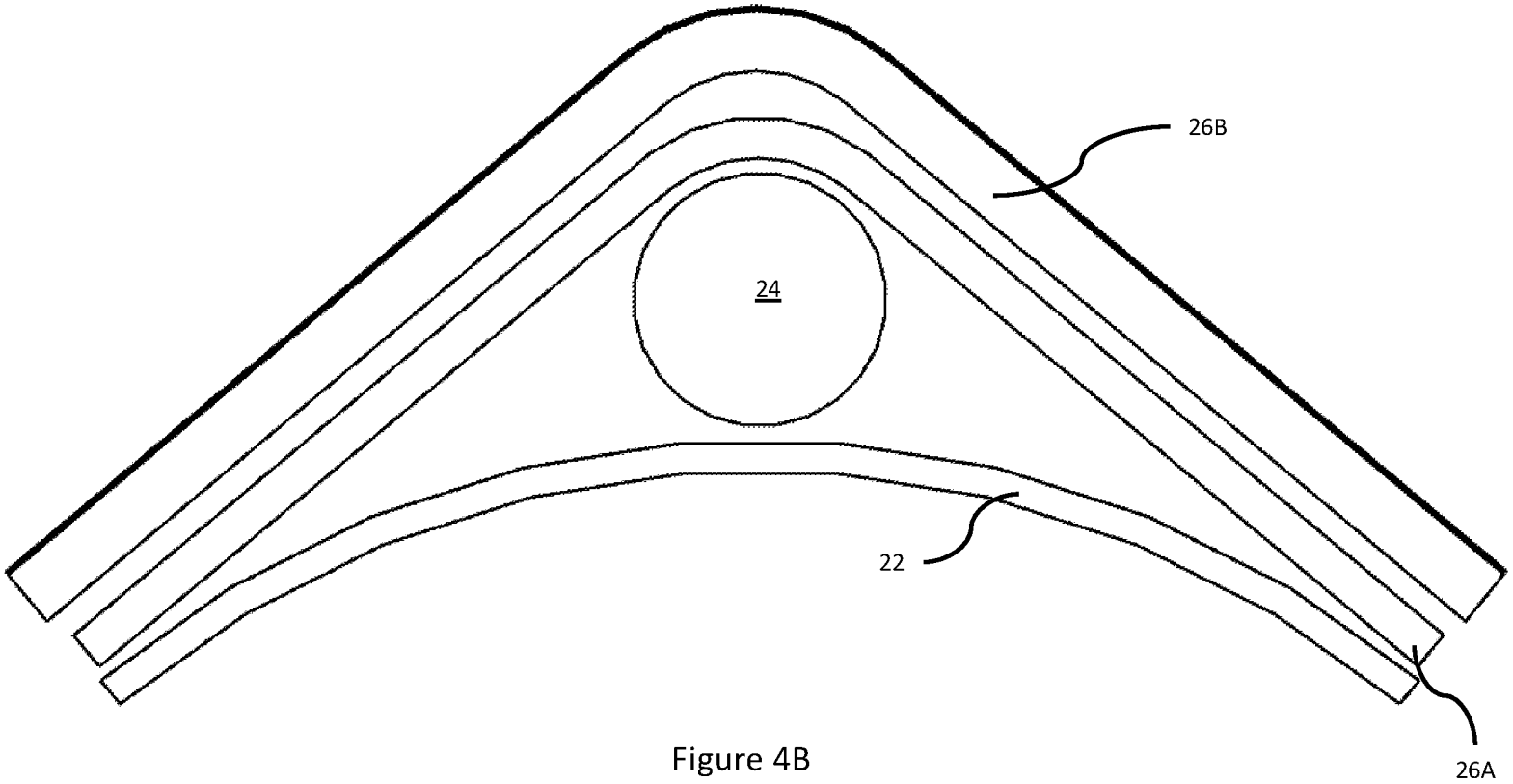
Figure 4C:
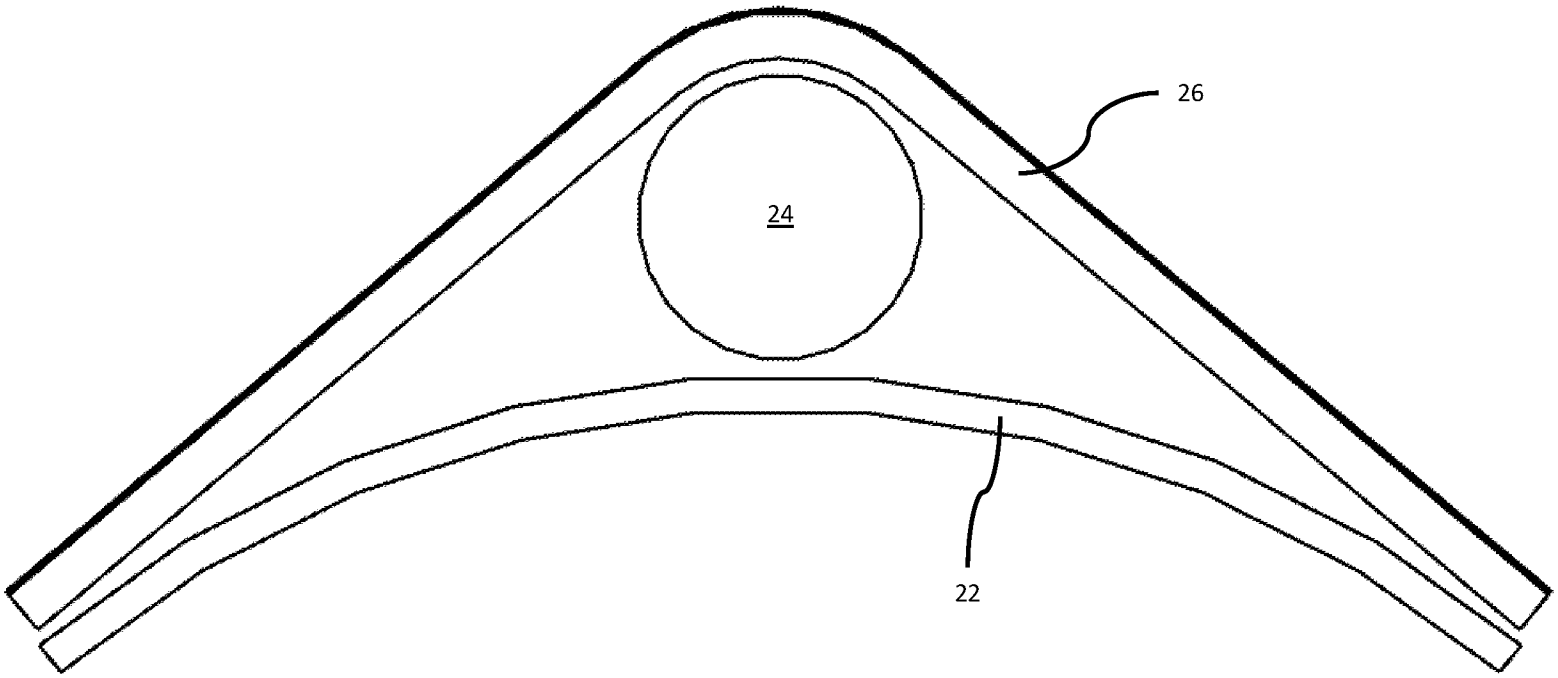

Characteristic of each of the architectures for a deployable, linear explosive charge structure shown in FIGS. 4A-4C is that the detonating cord 24 is located on the convex side of the carpenter's tape 22, the convex side being established when the structure is in the deployed state. In the schematic cross-section of the architecture shown in FIG. 4A, a single-sided adhesive tape 26A connects the detonating cord 24 to the convex side of the carpenter's tape 22 and the interior side of a two-sided adhesive tape 26B engages the concave side of the carpenter's tape. In the schematic cross-section of the architecture shown in FIG. 4B, a single-sided tape 26A connects the detonating cord 24 to the carpenter's tape 22 and the interior side of a two-sided adhesive tape 26B adheres to the single-sided adhesive tape 26A. In the schematic cross-section of the architecture shown in FIG. 4C, a two-sided adhesive tape 26 adheres to the convex side of the carpenter's tape 22.

Figure 5A:
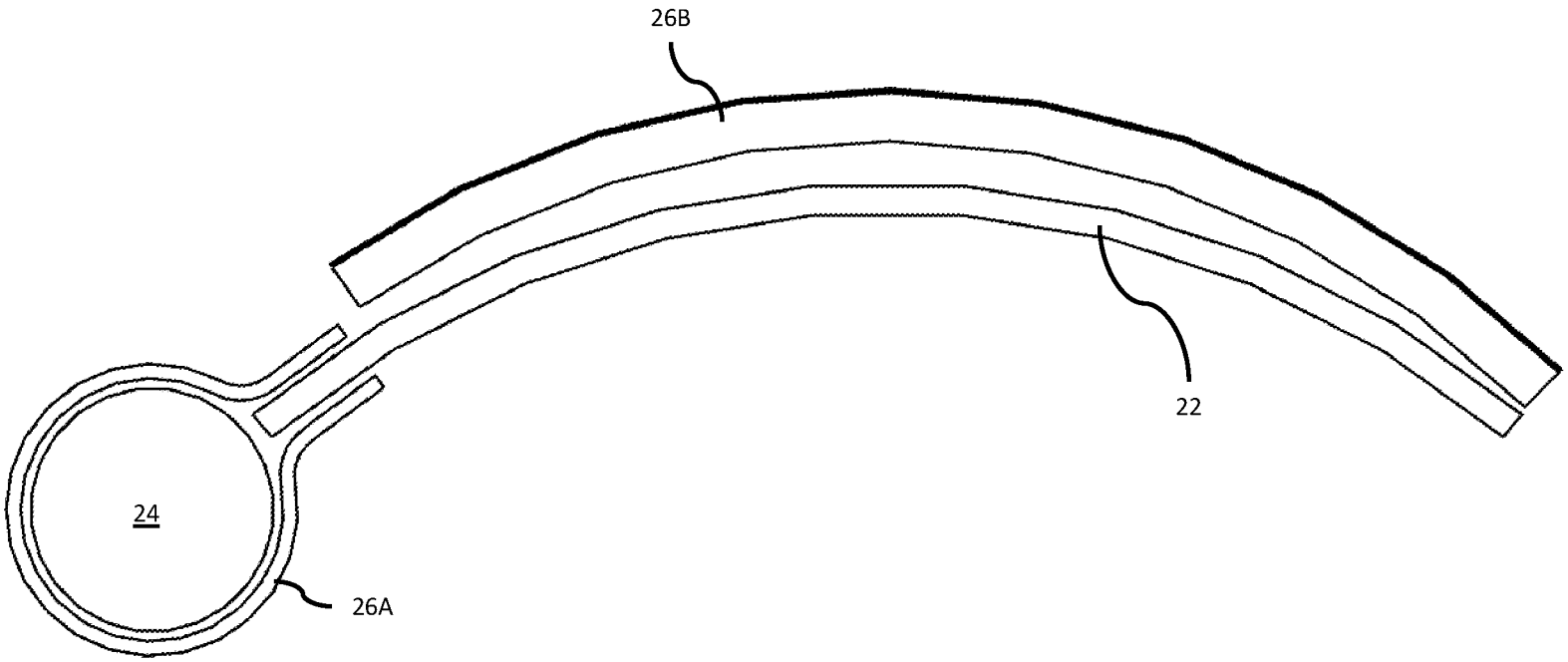
FIGS. 5A and 5B are schematic, cross-sectional views of two architectures of a deployable, linear explosive charge structure in which the explosive charge is located adjacent to the edge of the carpenter's tape when considered from the perspective of a deployed structure.
Figure 5B:
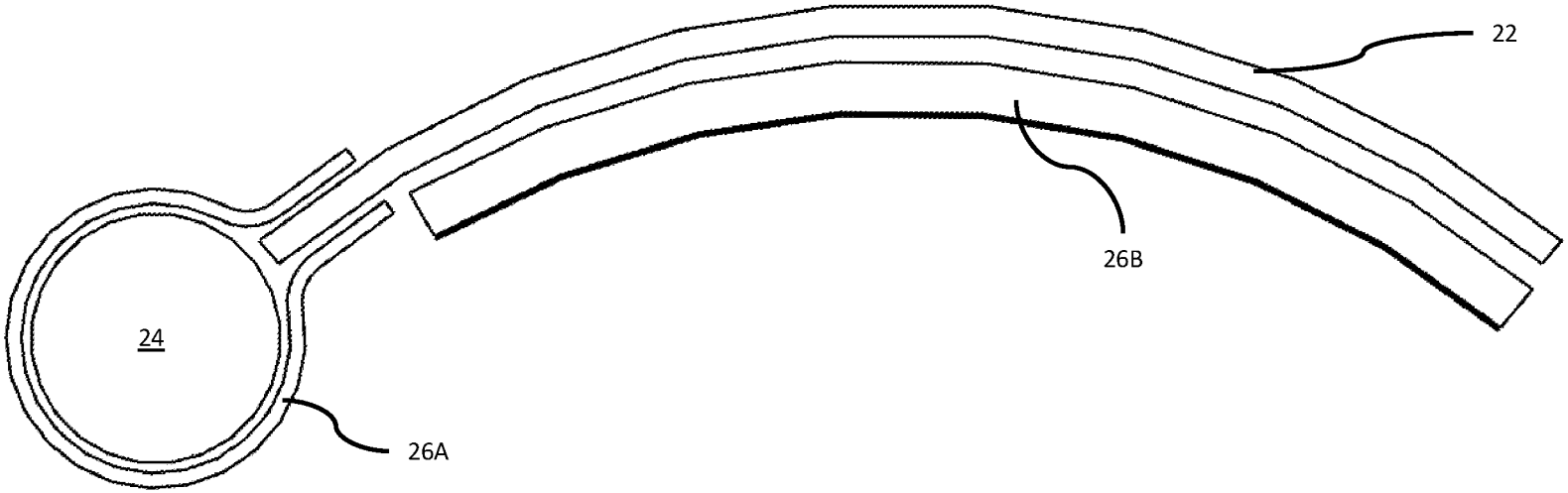

Characteristic of each of the architectures for a deployable, linear explosive charge structure shown in FIGS. 5A and 5B is that the detonating cord 24 is located adjacent to the edge of the carpenter's tape 22. In the schematic cross-section of the architecture shown in FIG. 5A, a single-sided adhesive tape 26A connects the detonating cord 24 adjacent to the edge of the carpenter's tape 22 and the interior side of a two-sided adhesive tape 26B engages the convex side of the carpenter's tape. In the schematic cross-section of the architecture shown in FIG. 5B, a single-sided adhesive tape 26A (or clips that engage the carpenter's tape) connects the detonating cord 24 adjacent to the edge of the carpenter's tape 22 and the interior side of a two-sided adhesive tape 26B engages the concave side of the carpenter's tape.

Figure 6:
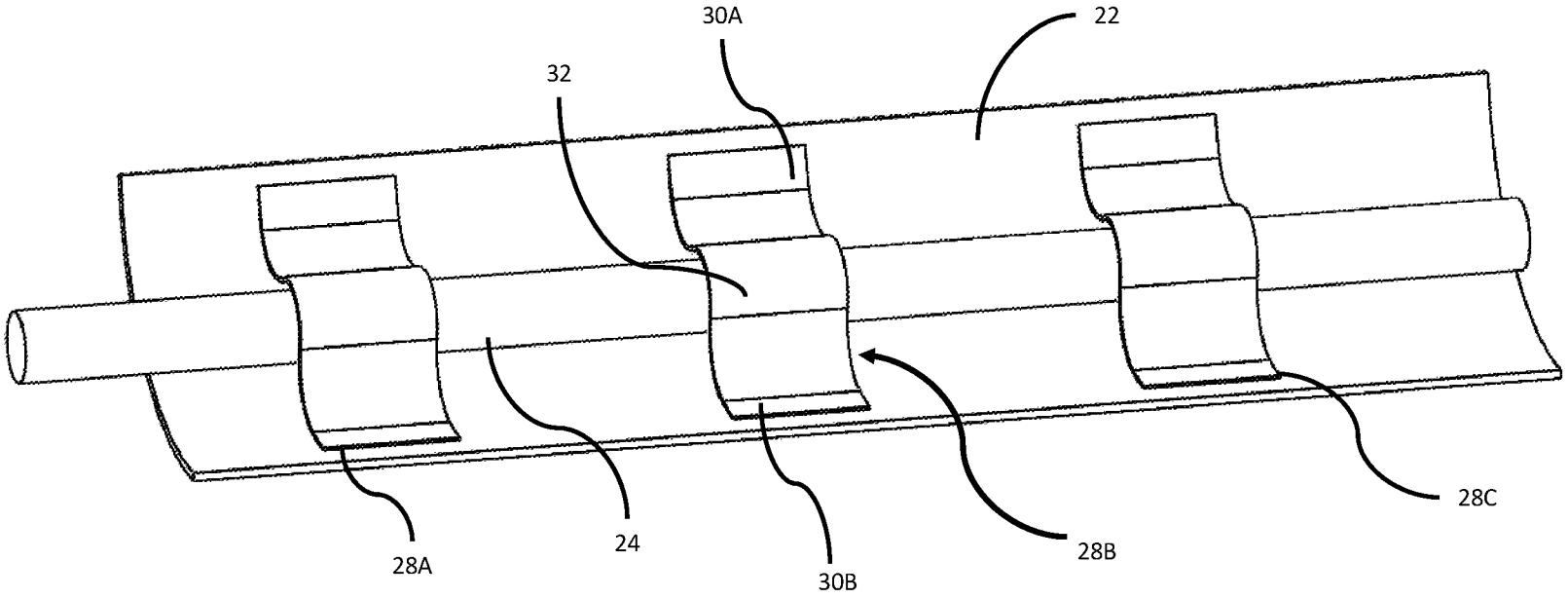
FIG. 6 illustrates the use of multiple sections of adhesive tape to connect the explosive charge and the carpenter's tape.

The adhesive tape used to connect the explosive charge to the carpenter's tape, in certain embodiments, can extend substantially the entire length of the carpenter's tape. However, using a single strip of adhesive tape of this length may be undesirable. With reference to FIG. 6, the connector for connecting the detonating cord 24 (or some other suitable explosive) to the carpenter's tape 22 is comprised of several strips of tape 28A-28C. Each of the strips of tape 28A-28C can, depending on the architecture, be a single-sided adhesive strip or a two-sided adhesive strip. If substantially the entire interior side of each of the strips of tape 28A-28C supports an adhesive, each of the strips adhesively engages both the detonating cord 24 and the carpenter's tape 22. However, the portion of the detonating cord 24 between consecutive strips of tape 28A-28C (for example, between strips of tape 28A, 28B) can move relative to the carpenter's tape 22 which may be desirable in certain embodiments of a deployable, linear explosive charge structure. Further, the interior side of one or more of the strips of tape 28A-28C can have two, adhesive edge sections that engage the carpenter's tape and a non-adhesive section extending between the adhesive edge sections that engages the detonating cord 24 but also allows the cord to slide back and forth. The strip of tape 28B is such a strip of tape. Specifically, the interior side of the tape 28B has adhesive edge sections 30A, 30B that engage the carpenter's tape 22 and serve to establish an enclosure that connects the carpenter's tape 22 and the detonating cord 24. The interior side of the tape 28B also has a non-adhesive section 32 extending between the adhesive edge sections 30A, 30B that engages the detonating cord 24 but allows the detonating cord to move back and forth if needed to place the structure in the undeployed state and/or to transition from the undeployed state towards the deployed state.

Figure 7A:
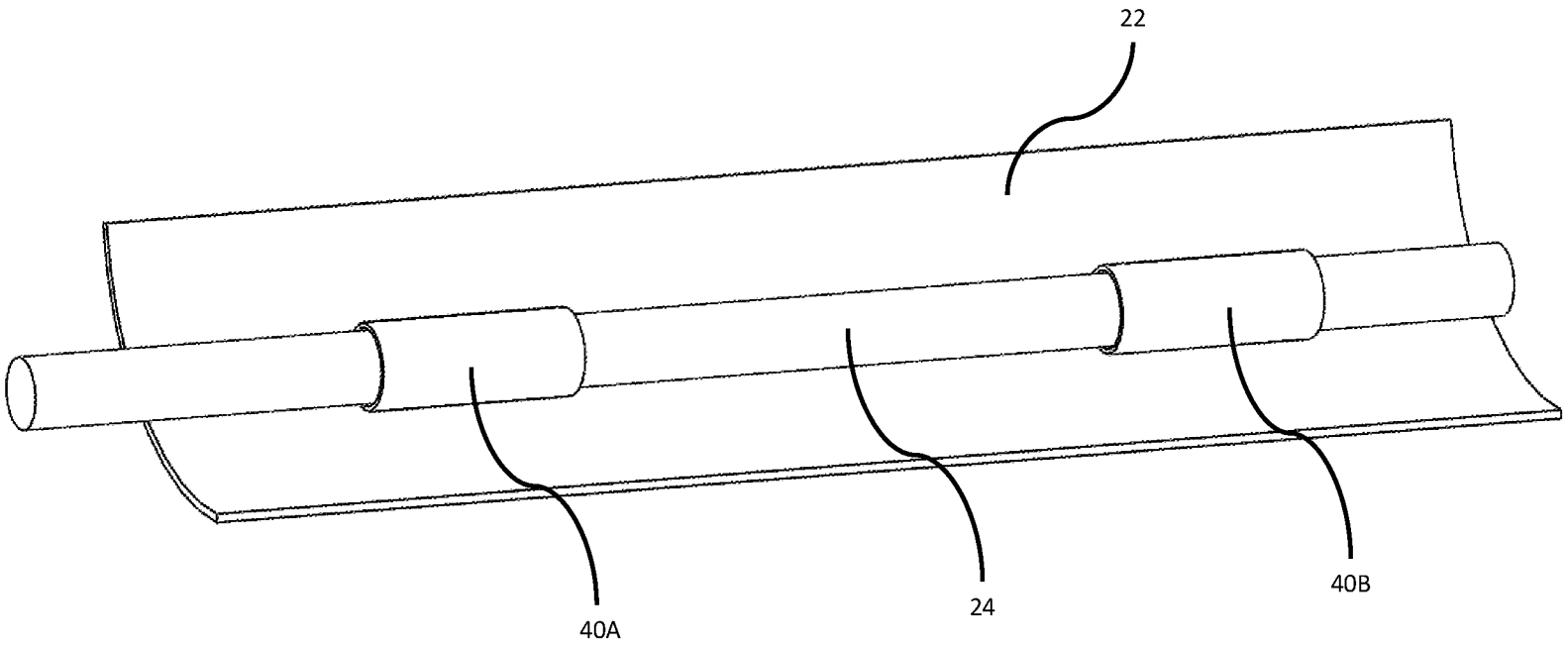
FIGS. 7A and 7B illustrate the use of multiple tubes to connect the explosive charge and the carpenter's tape.
Figure 7B:
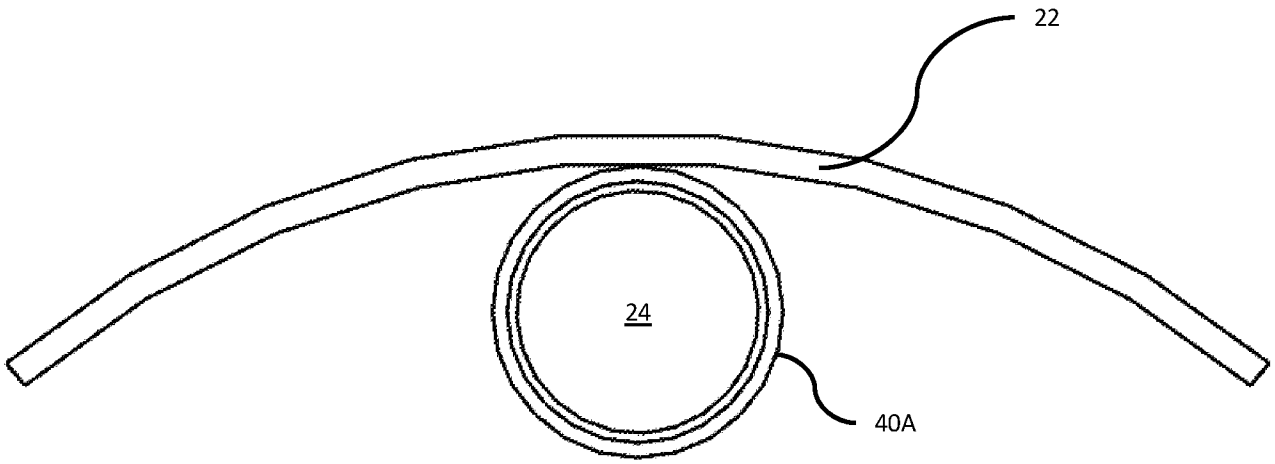

With reference to FIGS. 7A and 7B, another connector for connecting detonating cord 24 (or some other suitable explosive) to the carpenter's tape 22 is comprised of several tubular or straw-like sections 40A, 40B that are connected at spaced locations along the length of the carpenter's tape 22. Each of the tubular sections 40A, 40B is of sufficient inside dimension to receive the detonating cord 24 and to allow the detonating cord 24 some ability to slide back and forth if needed to place the structure in the undeployed state and/or transition from the undeployed state towards the deployed state. It should be appreciated that tubular structures with different cross-sectional shapes can be used to accommodate explosive charges with different cross-sections. The use of multiple tubular sections to connect the explosive charge to the carpenter's tape is likely to be most suitable or adaptable to deployable, linear explosive charge structures in which the undeployed state is either the flattened roll or the serpentine path. The tubular sections can have any suitable shape and/or cross section. For example, the tubular members may be lengthened or shortened to provide a desired coupling of the explosive charge to the tape. Longer tubular section may resemble a cylinder. Shorter tubular section may resemble a ring. Additionally, the cross section of the tubular sections may by circular or have any other suitable shape. For example, the cross section may be oval, square, rectangular, or any suitable shape that allows the explosive charge to pass therethrough.

As mentioned previously, one possible connector is a low-stiffness adhesive tape. The low-stiffness adhesive tape can provide desirable properties similar to the strips of tape 28A-28C and the tubular sections 40A, 40B. The low-stiffness adhesive tape can be used as the adhesive tape depicted in any of FIGS. 3A-3C, 4A-4C, 5A-5B, and 6, or FIGS. 9A-9D discussed hereinafter. Low-stiffness adhesive tape has flexible qualities that are different from other adhesive tapes. Low-stiffness adhesive tape can flex or "stretch" in one or both directions (length and width). The flexible tape secures the detonating cord 24 to the tape 22 but allows the detonating cord to move back and forth if needed to place the structure in the undeployed state and/or to transition from the undeployed state towards the deployed state. One example of low-stiffness adhesive tape can flex or stretch 150% to 180% in both directions. In this case, a 2-inch wide piece of tape can stretch up to 3.6 inches. Another example of low-stiffness adhesive tape can made of 95% cotton and 5% spandex. The amount of flexibility in a low-stiffness adhesive tape, and the particular structure/elements of a low-stiffness adhesive tape, can be chosen as desired for a particular explosive structure, while allowing the detonating cord 24 to maintain its position relative to the tape 22 in both the undeployed and deployed states.

When rolling (or folding) the structure, the position of the detonating cord 24 relative to the carpenter's tape 22 changes as the carpenter's tape 26 follows a larger, exterior path in the roll. Thus, when using a connector 22 that is more rigid, additional forces are incurred in the rolled structure. Particularly with regard to a bistable tape, these additional forces can inhibit stability of the tape in the undeployed state. Using a connector that allows the detonating cord 24 to shift with respect to the tape 22 when transitioning from the deployed state to the undeployed state (and from the undeployed state to the deployed state) can limit or remove the additional forces applied to the tape 22. Particularly with regard to a bistable tape, limiting these additional forces can allow the tape to remain stable in both the undeployed state and the deployed state.

Figure 8A:
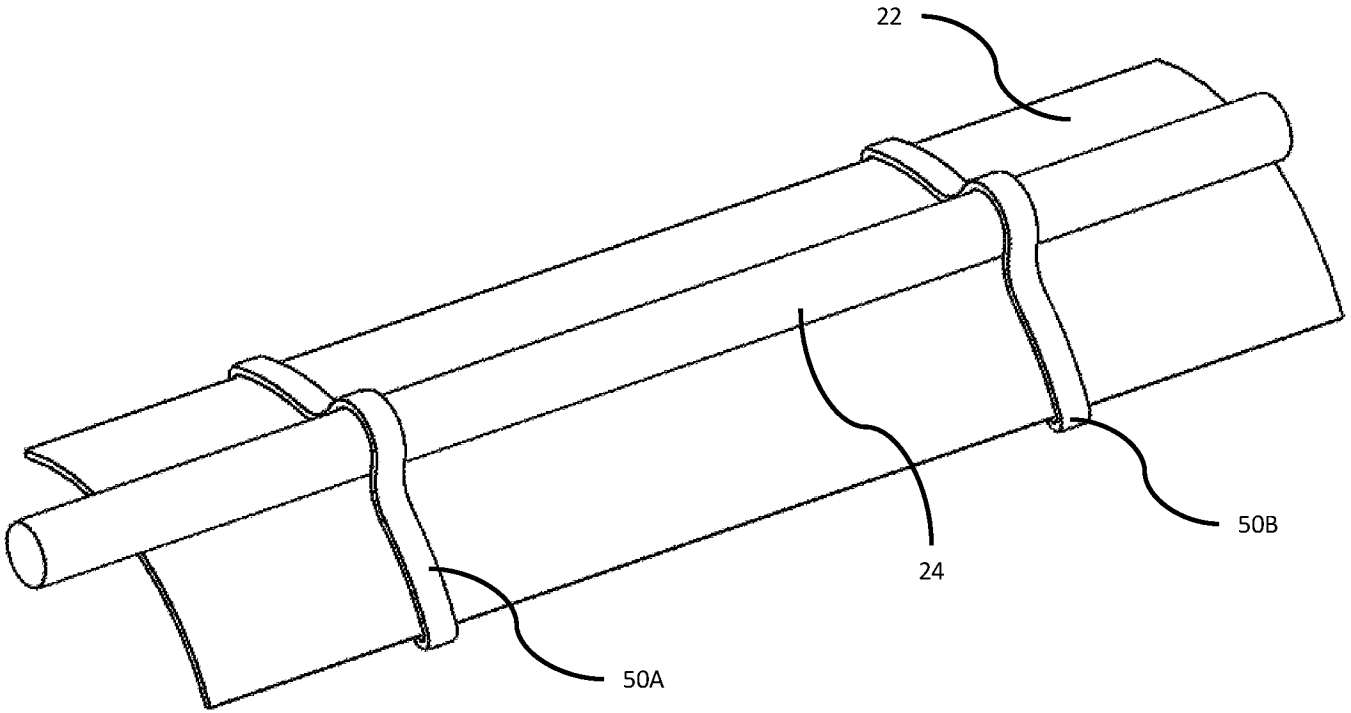
FIGS. 8A and 8B illustrate the use of multiple clips to connect the explosive charge and the carpenter's tape.
Figure 8B:
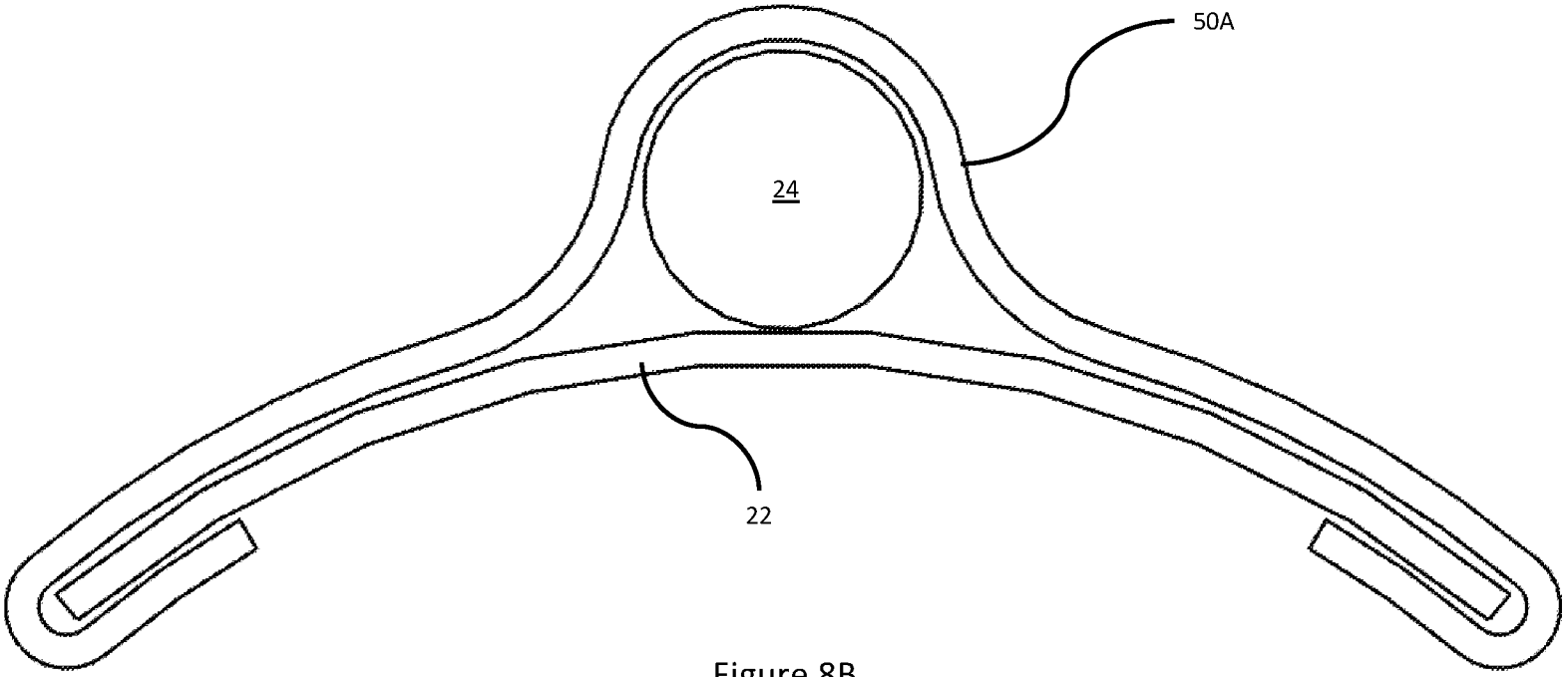

With reference to FIGS. 8A and 8B, another connector for connecting detonating cord 24 (or some other suitable explosive) to the carpenter's tape 22 is comprised of several clips SOA, SOB that are connected to the carpenter's tape 22. Each of the clips SOA, SOB operates to connect the detonating cord 24 to the carpenter's tape 22 and to allow the detonating cord 24 some ability to slide back and forth if needed to place the structure in the undeployed state and/or transition from the undeployed state towards the deployed state. It should be appreciated that clips for accommodating explosive charge with different cross-sectional shapes are feasible.

Figure 9A:
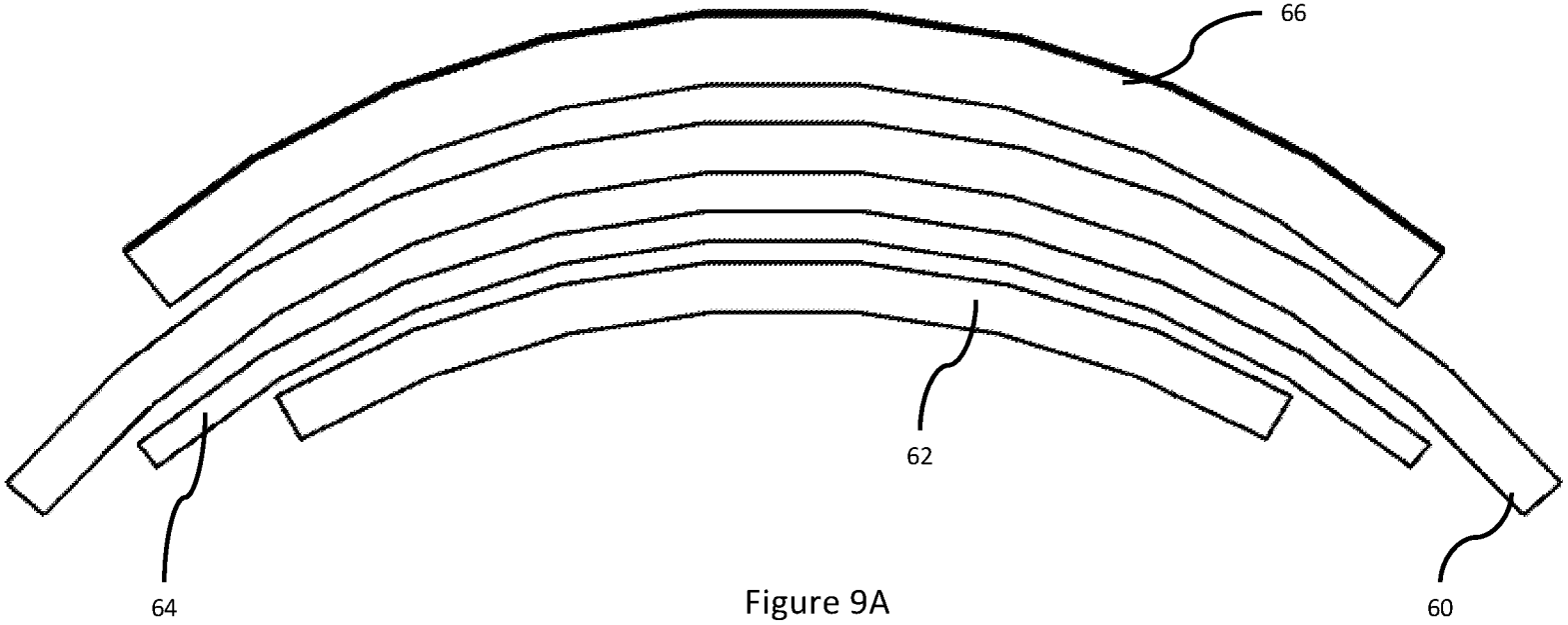
FIGS. 9A-9D are schematic, cross-sectional view of four architectures of a deployable, linear explosive charge structure that employs a flexible, planar explosive, such as Detasheet explosive.
Figure 9B:
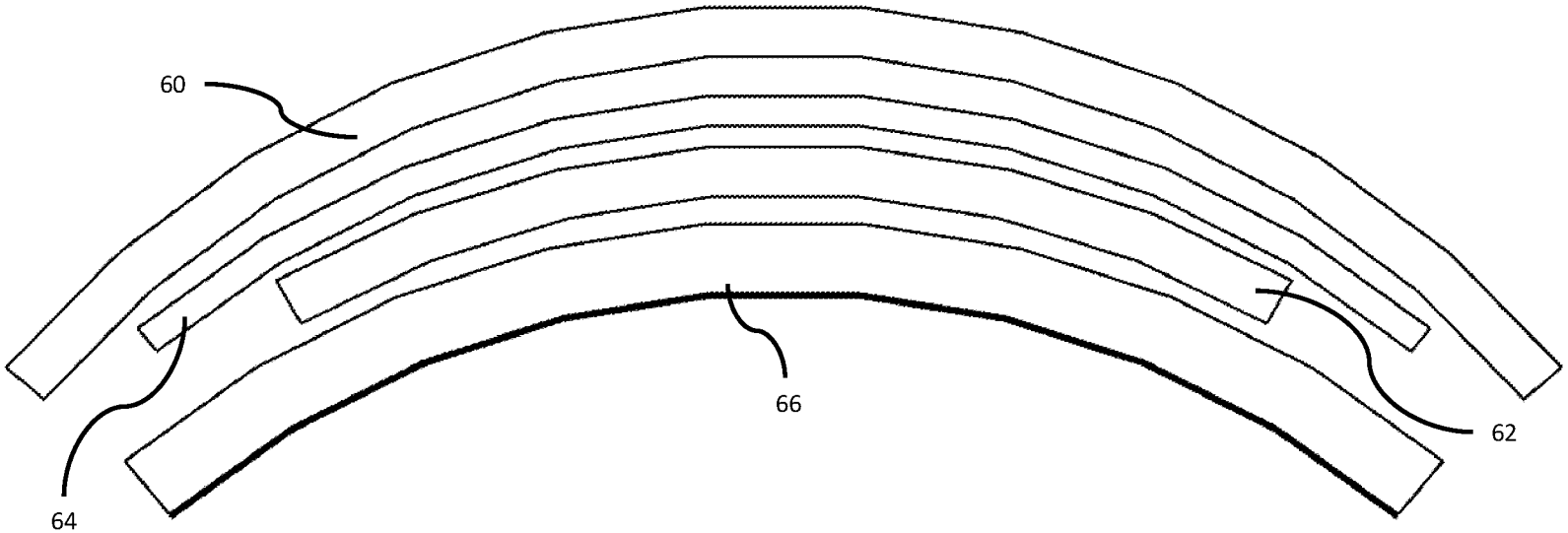
Figure 9C:
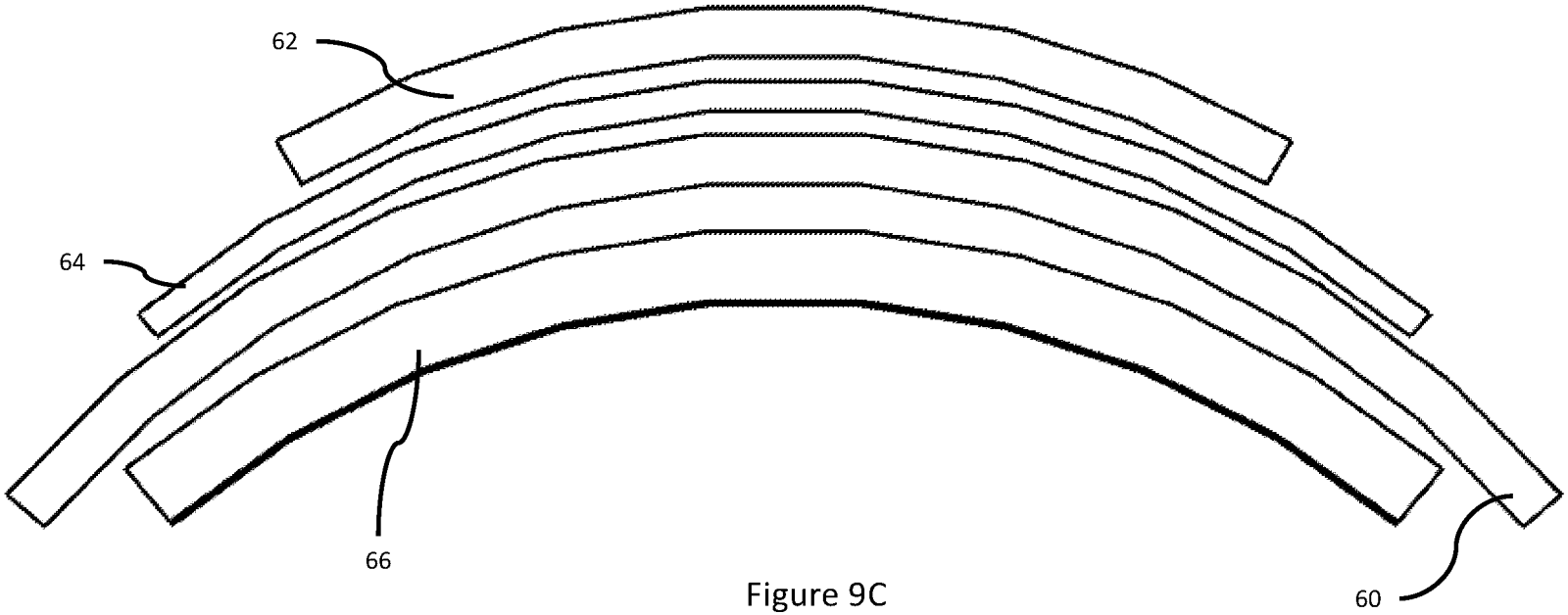
Figure 9D:
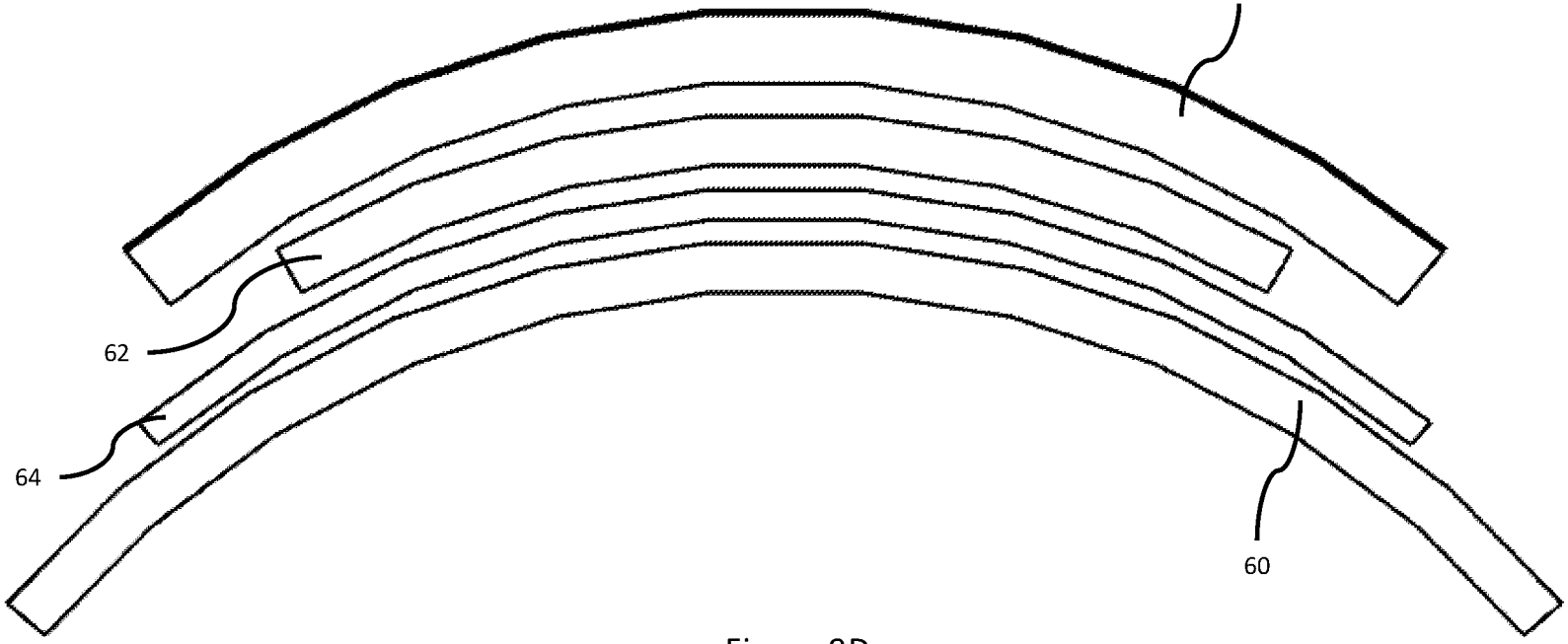

With reference to FIGS. 9A-9D, architectures for a deployable, linear explosive charge structure are described that use Detasheet explosive (or a similar explosive). Detasheet explosive is a flexible explosive that typically is manufactured or available in a planar form. The flexible and planar characteristics of Detasheet explosive facilitate different architectures for a deployable, linear explosive structure. To elaborate, the flexible and planar characteristics of Detasheet explosive allow the explosive to be connected to a carpenter's tape with one or more pieces of two-sided adhesive tape. As such, these architectures do not use the carpenter's tape and another piece of tape to form an enclosure for the explosive. One or more other pieces of two-sided adhesive tape are used to provide an adhesive interface for connecting the structure to an object of interest. Each of these architectures employs a carpenter's tape 60, Detasheet explosive 62 (or similar explosive), two-sided adhesive tape 64 to connect the Detasheet explosive 62 to the carpenter's tape 60, and two-sided adhesive tape 66 for connecting the structure to an object of interest (the removable backing associated with tape 66 being represented by the thicker line). Characteristic of the architectures shown in FIGS. 9A and 9B is that the Detasheet explosive is located on the concave side of the carpenter's tape 60 when viewed from the perspective of a deployed carpenter's tape. The curved shape that the Detasheet explosive takes on when the carpenter's tape 60 is in the deployed state facilitates the use of the Detasheet explosive as a "shaped" explosive charge. The architecture in which the Detasheet explosive is most likely to serve as a "shaped" explosive charge is the architecture shown in FIG. 9B. Characteristic of the architectures shown in FIGS. 9C and 9D is that the Detasheet explosive is located on the convex side of the carpenter's tape 60 when viewed from the perspective of a deployed carpenters tape. It should be appreciated that Detasheet explosive (or similar explosives) can also be used with the architectures shown in FIGS. 3A-3C and FIGS. 4A-4C (i.e., Detasheet explosive can replace the detonator cord 24 shown in each of these architectures).

The explosive structures and methods to deploy explosive structures described herein can provide many advantages. The carpenter's tape described herein is rigid in the linear, deployed state. Accordingly, the deployed explosive structure is a rigid structure that can promote faster and more accurate placement of the explosives, can hold the explosives in a desired position, and can facilitate reaching the explosives away from the operator. Additionally, deploying the explosive structure is an easier task as the tape can be fed out from the rolled position directly into the linear position.

Furthermore, the bistable carpenter's tape can be self-deploying. Once a portion of the bistable tape is moved from the rolled, undeployed position, the remainder of the tape will unroll to extend the tape to the linear deployed position. Such deployment can be almost instantaneous, reducing the time to deploy the structure and reducing the time on target (or otherwise in the dangerous situation).

The explosive structures and methods described herein provide a structure that can be assembled in a rigid state (the linear, deployed state of the tape), transitioned to a reduced size for storage or transportation (the rolled, undeployed state of the tape), and then transitioned again to the rigid state (the linear, deployed state of the tape) for deployment of the explosive charge. The carpenter's tape described herein can allow easier assembly of the explosive structure in the rigid state, faster and easier rolling of the explosive structure for storage and transportation, and faster and easier deployment of the explosive structure to the rigid state for deployment in the field.

The explosive structures and methods described herein also can reduce or eliminate damage to the explosive charge when moving the explosive structure from the rigid state, to the stored state, and back to the rigid state. The design of the carpenter's tape (both metal and bi-stable) reduces force applied to the attached explosive charge during transitions as the tape absorbs certain transverse forces by transitioning from a curved profile when deployed (linear) to a flat profile when undeployed (rolled), and when transitioning from the flat profile when undeployed (rolled) to the curved profile when deployed (linear). Additionally, various connectors described herein for attaching the explosive charge to the tape can further reduce forces applied to the explosive charge when rolling and unrolling the tape. For example, the flexible adhesive tape, tubular structures, and clips can allow the explosive charge to move relative to the tape as the tape is rolled and unrolled, thereby reducing forces applied to the explosive charge.

The components and systems described herein can be formed of any suitable material. A person having ordinary skill in the art and the benefit of this disclosure will understand that multiple options exist for manufacturing the components and structures described herein.

The example systems, methods, and components described in the embodiments presented previously are illustrative, and, in alternative embodiments, certain components can be combined in a different order, omitted entirely, and/or combined between different example embodiments, and/or certain additional components can be added, without departing from the scope and spirit of various embodiments. Accordingly, such alternative embodiments are included in the scope of the following claims, which are to be accorded the broadest interpretation so as to encompass such alternate embodiments.

Although specific embodiments have been described above in detail, the description is merely for purposes of illustration. It should be appreciated, therefore, that many aspects described above are not intended as required or essential elements unless explicitly stated otherwise. Modifications of, and equivalent components or acts corresponding to, the disclosed aspects of the example embodiments, in addition to those described above, can be made by a person of ordinary skill in the art, having the benefit of the present disclosure, without departing from the spirit and scope of the invention defined in the following claims, the scope of which is to be accorded the broadest interpretation so as to encompass such modifications and equivalent structures.

What is claimed is:

1. An explosive structure, comprising:

a bistable structural tape comprising an undeployed state and a deployed state, the structural tape having a rolled, flat transverse profile in the undeployed state, and the structural tape having a linear, curved transverse profile in the deployed state, the structural tape being stable in the undeployed state and in the deployed state and being unstable when between states such that transitioning one end of the tape from the rolled shape to the linear shape places the tape in an unstable state causing the tape to self-deploy to the deployed state;

an explosive charge;

a connector that couples the explosive charge along a length of the structural tape, wherein the explosive structure can be compacted into the undeployed state of the structural tape and extended into the deployed state of the structural tape.

2. The explosive structure according to claim 1, wherein the connector is two-sided adhesive tape comprising a sacrificial member on an exterior side of the connector, wherein an interior side of the connector couples the explosive charge to the structural tape.

3. The explosive structure according to claim 1, further comprising an adhesive member coupled to the explosive structure to connect the explosive structure to another structure.

4. The explosive structure according to claim 3, wherein the adhesive member is two-sided adhesive tape.

5. The explosive structure according to claim 3, wherein the adhesive member is coupled to the structural tape.

6. The explosive structure according to claim 3, wherein the adhesive member is coupled to the connector.

7. The explosive structure according to claim 3, wherein the adhesive member is coupled to the explosive charge.

8. The explosive structure according to claim 1, wherein the structural tape is a metallic tape.

9. The explosive structure according to claim 8, further comprising a restraining mechanism that holds the explosive structure in the undeployed state of the structural tape.

10. The explosive structure according to claim 1, wherein the connector comprises an adhesive tape.

11. The explosive structure according to claim 10, wherein the adhesive tape comprises a low-stiffness adhesive tape.

12. The explosive structure according to claim 1, wherein the connector comprises a plurality of strips of adhesive tape applied at intervals transversely across the explosive charge.

13. The explosive structure according to claim 12, wherein at least one of the strips of adhesive tape comprises adhesive sections at the ends of the strip of adhesive tape and a non-adhesive section between the adhesive sections, the adhesive sections adhering to the structural tape, and the non-adhesive section disposed around at least a portion of the explosive charge.

14. The explosive structure according to claim 1, wherein the connector comprises a plurality of tubular members coupled to the structural tape, wherein the explosive charge passes through the tubular members.

15. The explosive structure according to claim 14, wherein the tubular members comprise a circular cross-section.

16. The explosive structure according to claim 1, wherein the connector comprises a plurality of clips that each attach to the structural tape around at least a portion of the explosive charge.

17. The explosive structure according to claim 1, wherein the explosive charge comprises a cord explosive.

18. The explosive structure according to claim 1, wherein the explosive charge comprises a sheet explosive.

19. The explosive structure according to claim 1, wherein the explosive charge is disposed on a convex side of the structural tape when the structural tape is in the deployed state.

20. The explosive structure according to claim 1, wherein the explosive charge is disposed on a concave side of the structural tape when the structural tape is in the deployed state.

21. The explosive structure according to claim 1, wherein the explosive charge is disposed on an edge of the structural tape.

22. The explosive structure according to claim 1, wherein the rolled profile of the structural tape in the undeployed state comprises a serpentine or a folded configuration.

23. A kit for an explosive structure, comprising:

a bistable, self-deployable structural tape comprising an undeployed state and a deployed state, the structural tape having a rolled, flat transverse profile in the undeployed state, and the structural tape having a linear, curved transverse profile in the deployed state, the structural tape being stable in the undeployed state and in the deployed state and being unstable when between states such that transitioning one end of the tape from the rolled shape to the linear shape places the tape in an unstable state causing the tape to self-deploy to the deployed state;

a connector to couple an explosive charge along a length of the structural tape, wherein, when an explosive charge is coupled along the length of the structural tape via the connector, the explosive structure can be compacted into the undeployed state of the structural tape and extended into the deployed state of the structural tape.

24. A method to support an explosive along a linear structure for transportation and deployment, comprising:

providing a bistable, self-deployable structural tape in an undeployed state, the structural tape comprising the undeployed state and a deployed state, the structural tape having a rolled, flat transverse profile in the undeployed state, and the structural tape having a linear, curved transverse profile in the deployed state, the structural tape being stable in the undeployed state and in the deployed state and being unstable when between states such that transitioning one end of the tape from the rolled shape to the linear shape places the tape in an unstable state causing the tape to self-deploy to the deployed state;

deploying the structural tape into the deployed state;

disposing an explosive charge lengthwise along the deployed structural tape;

placing adhesive tape over the explosive charge to couple the explosive charge to the structural tape; and rolling the structural tape and the coupled explosive charge into the undeployed state of structural tape.

* * * * *